US011071365B2

(12) United States Patent
Maclaine et al.

(10) Patent No.: US 11,071,365 B2
(45) **Date of Patent: *Jul. 27, 2021**

(54) ATTACHMENT FOR A HAND HELD APPLIANCE

(71) Applicant: Dyson Technology Limited, Wiltshire (GB)

(72) Inventors: Alasdair Michael Maclaine, London (GB); Robert Lawrence Tweedie, Swindon (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/656,432

(22) Filed: Mar. 12, 2015

(65) Prior Publication Data

US 2015/0265023 A1 Sep. 24, 2015

(30) Foreign Application Priority Data

Mar. 20, 2014 (GB) ..... 1404983

(51) Int. Cl.
*A45D 20/50* (2006.01)
*A45D 20/12* (2006.01)
(Continued)

(52) U.S. Cl.
CPC ..... *A45D 20/12* (2013.01); *A45D 2/36* (2013.01); *A45D 20/50* (2013.01); *A46B 9/023* (2013.01);
(Continued)

(58) Field of Classification Search
CPC ... A45D 1/02; A45D 2/06; A45D 2/10; A45D 2/2414; A45D 2/2421; A45D 2/245;
(Continued)

(56) References Cited

U.S. PATENT DOCUMENTS 1,504,988 A 8/1924 Speetjens
2,476,002 A 7/1949 Stalker
(Continued)

FOREIGN PATENT DOCUMENTS

CN 1205617 1/1999
CN 101662969 3/2010
(Continued)

OTHER PUBLICATIONS

Search Report dated Sep. 12, 2014, directed to GB Application No. 1404983.7; 1 page.
(Continued)

*Primary Examiner* — Yogesh P Patel
*Assistant Examiner* — Jennifer Gill
(74) *Attorney, Agent, or Firm* — Morrison & Foerster LLP

(57) ABSTRACT

An attachment for a hand held appliance comprising a body having a wall, a fluid inlet at one end of the wall and a fluid outlet through the wall wherein the fluid outlet comprises at least one slot extending along the wall and wherein the at least one slot is formed by an overlap of a first end of the wall and a second end of the wall. The wall may be formed from at least two plates. A first one of the at least two plates may comprise the first end of the wall and a second one may comprise the second end of the wall. The first of the at least two plates may define a radially inner surface of the slot. The second one of the at least two plates may define a radially outer surface of the slot. The slot may be tangential to the wall.

44 Claims, 17 Drawing Sheets

(51) Int. Cl.
*A46B 9/02* (2006.01)
*A46B 15/00* (2006.01)
*A45D 2/36* (2006.01)

(52) U.S. Cl.
CPC .... *A46B 15/0051* (2013.01); *A46B 2200/104* (2013.01)

(58) Field of Classification Search
CPC .... A45D 20/122; A45D 20/124; A45D 20/50; A45D 2/125; A45D 2/127; A45D 2/14; A45D 2/22; A45D 2/24; A45D 2/2407; A45D 2/2457; A45D 2/2464; A45D 2/2485; A45D 2/2492; A45D 20/10; A45D 2/12; A45D 4/04; A45D 4/08; A45D 4/12; A45D 6/02; A45D 7/02; A46B 9/023; A46B 15/003
USPC ..... D28/10, 12, 18, 15; D32/31; 34/96, 97, 34/98, 99
See application file for complete search history.

(56) References Cited

U.S. PATENT DOCUMENTS 3,107,675 A 10/1963 Embiricos
3,224,454 A 12/1965 Quinio et al.
3,696,818 A 10/1972 Weber
3,814,898 A 6/1974 Levine
3,835,869 A 9/1974 Newman et al.
3,837,581 A * 9/1974 Orsoff ..... A45D 20/122 239/289
3,857,016 A 12/1974 Meyer et al.
3,890,984 A 6/1975 Lesetar
3,939,850 A * 2/1976 Wahl ..... A45D 20/50 132/148
3,981,313 A 9/1976 Burke et al.
3,990,460 A 11/1976 Shalvoy
4,197,448 A 4/1980 Harigai
4,214,597 A 7/1980 Glassman
4,250,902 A * 2/1981 Ihara ..... A45D 20/50 132/271
4,295,283 A * 10/1981 Tomaro ..... A45D 20/124 239/383
4,422,464 A 12/1983 Josefsson
4,430,808 A 2/1984 Toyomi et al.
4,456,020 A * 6/1984 van Deursen ..... A45D 2/24 132/237
4,471,791 A 9/1984 DeRoche
4,602,146 A 7/1986 Barns et al.
4,827,105 A 5/1989 Brown, Jr.
4,856,542 A * 8/1989 Hollenberg ..... A45D 2/24 132/248
5,091,630 A 2/1992 Djuric
5,157,757 A 10/1992 McDougall
5,212,366 A * 5/1993 McDougall ..... A45D 20/50 132/212
5,513,665 A 5/1996 Chan
5,515,874 A * 5/1996 Denebeim ..... A45D 2/24 132/210
5,546,674 A 8/1996 Lange et al.
5,626,156 A * 5/1997 Vicory, Sr. ..... A45D 2/10 132/229
5,660,191 A 8/1997 Bontoux et al.
5,661,910 A 9/1997 Schepisi
5,740,820 A * 4/1998 Stern ..... A45D 2/362 132/228
5,765,575 A * 6/1998 Denebeim ..... A45D 1/04 132/227
5,842,286 A 12/1998 Cantor
5,868,148 A * 2/1999 Lindsey ..... A45D 20/122 132/129
5,894,849 A * 4/1999 Ehlhardt ..... A45D 20/50 132/271
5,966,833 A 10/1999 Andis et al.
6,038,782 A 3/2000 Schepisi
6,377,749 B2 4/2002 Ohmura
6,662,811 B2 12/2003 Mugge et al.
6,668,840 B1 12/2003 Mugge et al.
6,739,071 B2 5/2004 Andis et al.
7,124,763 B2 10/2006 Hafemann
7,631,646 B2 12/2009 Ragosta et al.
8,092,166 B2 1/2012 Nicolas et al.
8,122,896 B2 2/2012 Obermann
8,353,303 B2 1/2013 Kim
8,407,913 B2 4/2013 Langley et al.
9,526,310 B2 12/2016 Courtney et al.
9,752,789 B2 9/2017 Staniforth et al.
9,982,677 B2 5/2018 Beavis et al.
10,094,392 B2 10/2018 Poulton et al.
2002/0092196 A1 7/2002 Tobin et al.
2003/0079366 A1 5/2003 Chang
2003/0177657 A1 9/2003 Andis et al.
2004/0129289 A1 7/2004 Hafemann
2007/0119069 A1 5/2007 Shim
2007/0137060 A1 6/2007 Woodson
2008/0041406 A1 2/2008 Le
2009/0145002 A1 6/2009 Brewer et al.
2009/0293901 A1* 12/2009 Chan ..... A45D 2/146 132/245
2010/0226797 A1* 9/2010 Fitton ..... F24F 1/01 417/313
2011/0198421 A1 8/2011 Yoe
2013/0008043 A1* 1/2013 Correll, Jr. ..... A45D 20/12 34/97
2013/0104415 A1* 5/2013 Han ..... A45D 20/00 34/283
2013/0111777 A1* 5/2013 Jeong ..... A45D 20/12 34/97
2013/0133682 A1 5/2013 Yoe et al.
2013/0160316 A1 6/2013 Hadden
2013/0269205 A1* 10/2013 Hada ..... A45D 20/10 34/283
2014/0007448 A1 1/2014 Courtney et al.
2014/0083446 A1 3/2014 Julemont et al.
2014/0144037 A1 5/2014 Hadden
2014/0366910 A1* 12/2014 Habibi ..... A45D 20/52 132/227
2015/0265022 A1 9/2015 MacLaine
2015/0265024 A1 9/2015 MacLaine
2016/0000201 A1* 1/2016 Doran ..... A45D 20/10 132/228
2016/0356287 A1 12/2016 Khalitov et al.
2017/0273421 A1 9/2017 Heffer et al.
2017/0273422 A1 9/2017 Heffer et al.
2017/0273423 A1 9/2017 Mason et al.
2017/0273425 A1* 9/2017 Stephens ..... A45D 20/12

FOREIGN PATENT DOCUMENTS

CN 201691269 1/2011
CN 201986906 9/2011
CN 2026534-44 U 1/2013
CN 103027468 A 4/2013
CN 203106087 8/2013
CN 204838408 12/2015
CN 207023591 U 2/2018
DE 568043 1/1933
DE 6928170 7/1969
DE 26 18 819 11/1977
DE 79 25 952 1/1980
DE 29816450 U1 3/1999
EP 0 482 906 4/1992
EP 2 823 726 1/2015
GB 725095 3/1955
GB 1 295 924 11/1972
GB 1 407 403 9/1975
GB 1 465 855 3/1977
GB 2 100 981 1/1983
GB 2515812 1/2015
GB 2524304 9/2015
GB 2526049 11/2015

(56) References Cited

FOREIGN PATENT DOCUMENTS

| | | |
|---|---|---|
| GB | 2527834 | 1/2016 |
| JP | 57-196907 | 12/1982 |
| JP | 60-100902 | 6/1985 |
| JP | 60-134402 | 9/1985 |
| JP | 61-145248 | 9/1986 |
| JP | 62-41606 | 2/1987 |
| JP | 64-29208 | 1/1989 |
| JP | 6-7217 | 1/1994 |
| JP | 10-42932 | 2/1998 |
| JP | 10-71019 | 3/1998 |
| JP | 10-179238 | 7/1998 |
| JP | 2000-516483 | 12/2000 |
| JP | 3233749 | 11/2001 |
| JP | 2004-222745 | 8/2004 |
| JP | 2004-225705 | 8/2004 |
| JP | 2005-177155 | 7/2005 |
| JP | 2007-105144 | 4/2007 |
| JP | 2010-201067 | 9/2010 |
| JP | 2013-59580 | 4/2013 |
| JP | 2016-16328 | 2/2016 |
| KR | 20-0388514 | 6/2005 |
| KR | 10-2008-0030428 | 4/2008 |
| KR | 10-2012-0095206 | 8/2012 |
| RU | 2417719 | 5/2011 |
| SU | 1340734 | 9/1987 |
| WO | WO-79/00374 | 6/1979 |
| WO | WO-92/14378 | 9/1992 |
| WO | WO-97/23147 | 7/1997 |
| WO | WO-98/27842 | 7/1998 |
| WO | WO-2007/077040 | 7/2007 |
| WO | WO-2015/140506 | 9/2015 |
| WO | 2015/190217 | 12/2015 |

OTHER PUBLICATIONS

MacLaine, Office Action dated May 22, 2017, directed to U.S. Appl. No. 14/656,375; 8 pages.

MacLaine, U.S. Office Action dated Feb. 14, 2017, directed to U.S. Appl. No. 14/656,357; 15 pages.

MacLaine, Office Action dated Jan. 6, 2017, directed to U.S. Appl. No. 14/656,375; 7 pages.

MacLaine, U.S. Office Action dated Aug. 9, 2017, directed to U.S. Appl. No. 14/656,357; 13 pages.

MacLaine, Office Action dated Dec. 8, 2017, directed to U.S. Appl. No. 14/656,375; 7 pages.

MacLaine, U.S. Office Action dated Jan. 10, 2018, directed to U.S. Appl. No. 14/656,357; 11 pages.

MacLaine, U.S. Office Action dated Jun. 27, 2018, directed to U.S. Appl. No. 14/656,357; 13 pages.

Heffer et al, U.S. Office Action dated May 14, 2019, directed to U.S. Appl. No. 15/468,487; 13 pages.

Heffer et al., U.S. Office Action dated May 15, 2019, directed to U.S. Appl. No. 15/468,500; 20 pages.

Mason et al., U.S. Office Action dated May 23, 2019, directed to U.S. Appl. No. 15/468,502; 22 pages.

MacLaine, U.S. Office Action dated Dec. 14, 2018, directed to U.S. Appl. No. 14/656,357; 12 pages.

Heffer et al., U.S. Office Action dated Dec. 27, 2019, directed to U.S. Appl. No. 15/468,500; 19 pages.

MacLaine, U.S. Office Action dated Sep. 18, 2019, directed to U.S. Appl. No. 14/656,357; 14 pages.

Mason et al., U.S. Office Action dated Feb. 28, 2020, directed to U.S. Appl. No. 15/468,502; 17 pages.

Heffer et al., U.S. Office Action dated Jul. 2, 2020, directed to U.S. Appl. No. 15/468,500; 22 pages.

Maclaine, U.S. Office Action dated Apr. 15, 2020, directed to U.S. Appl. No. 14/656,357; 11 pages.

Mason et al., U.S. Office Action dated Aug. 28, 2020, directed to U.S. Appl. No. 15/468,502; 15 pages.

Heffer et al., U.S. Office Action dated Oct. 15, 2020, directed to U.S. Appl. No. 15/468,500; 15 pages.

Mason et al., U.S. Office Action dated Dec. 18, 2020, directed to U.S. Appl. No. 15/468,502; 14 pages.

* cited by examiner

ATTACHMENT FOR A HAND HELD APPLIANCE

REFERENCE TO RELATED APPLICATIONS

This application claims the priority of United Kingdom Application No. 1404983.7, filed Mar. 20, 2014, the entire contents of which are incorporated herein by reference.

FIELD OF THE INVENTION

This invention relates to an attachment for a hand held appliance, in particular a hair care appliance such as a hot styling brush.

BACKGROUND OF THE INVENTION

In a conventional hot styling brush, air is sucked into an inlet by a fan unit and directed towards the hair by an attachment or head. Depending on the style desired, the air may or may not be heated. The head or attachment often includes bristles onto which hair is wrapped and held for styling. The air is generally blown out of the head or attachment normal to the surface of the head.

SUMMARY OF THE INVENTION

The present invention provides an attachment for a hand held appliance comprising a body having a wall, a fluid inlet at one end of the wall and a fluid outlet through the wall wherein the fluid outlet comprises at least one slot extending along the wall and wherein the at least one slot is formed by an overlap of a first end of the wall and a second end of the wall.

Preferably, the fluid emitted from the fluid outlet is attracted to an external surface of the wall. Preferably, fluid emitted from the fluid outlet flows around the external surface of the wall.

Preferably, the wall is formed from at least two plates. It is preferred that a first one of the at least two plates comprises the first end of the wall. Preferably, a second one of the at least two plates comprises the second end of the wall. It is preferred that the first of the at least two plates defines a radially inner surface of the slot. Preferably, the second one of the at least two plates defines a radially outer surface of the slot.

Preferably, the attachment is generally tubular with the at least two plates extending longitudinally along the tube and radially around the tube. Preferably the slot extends longitudinally along the tube.

It is preferred that the slot is tangential to the wall. Preferably, fluid exiting the fluid outlet flows along a radially inner surface of the slot. The radially inner surface of the slot becomes the external surface of the attachment when a downstream end of the overlap between the first end of the wall and the second end of the wall is reached. The fluid flows around the attachment combining with fluid that exits from any further slots which form a part of the fluid outlet.

The fluid exiting the fluid outlet is encouraged to follow the line of the radially inner surface creating a flow around the attachment which pulls hair towards the attachment and wraps the hair around the attachment in the direction of fluid flow.

Preferably, the attachment comprises n slots and n plates.

It is preferred that one of the first end and second end of the wall includes a spacer which defines a thickness of the slot.

Another aspect of the invention provides an attachment for a hand held appliance comprising a body having a wall, a fluid inlet at one end of the wall and a fluid outlet through the wall wherein the fluid outlet comprises at least one slot extending along the wall wherein the at least one slot is formed by an overlap of a first end of the wall and a second end of the wall and wherein one of the first end and second end of the wall includes a spacer which defines a thickness of the slot.

Preferably, the second end of the wall comprises the spacer.

It is preferred that a pair of spacers are provided longitudinally spaced along the wall.

Any spacers maintain the gap between the two parts forming the slot or thickness of the slot. It is advantageous for these to all be substantially equal is this creates an even flow around the attachment.

Preferably, the at least one slot is formed as a spiral around the wall. It is preferred that the spiral is clockwise in the direction of fluid flow. Alternatively, the spiral is anti-clockwise in the direction of fluid flow. Preferably, the slot is disposed at an angle of 1-89° to a longitudinal direction of the attachment. It is preferred that the slot is disposed at an angle of 10-70° to a longitudinal direction of the attachment. Preferably, the slot is disposed at an angle of 30-60° to a longitudinal direction of the attachment.

More preferably, the slot is disposed at an angle of 45° to a longitudinal direction of the attachment.

Another aspect of the invention provides an attachment for a hand held appliance comprising a body having a wall, a fluid inlet at one end of the wall and a fluid outlet through the wall wherein the fluid outlet comprises at least one slot extending along the wall wherein the at least one slot is formed by an overlap of a first end of the wall and a second end of the wall and wherein the slot is disposed at an angle of 1-89° to a longitudinal direction of the attachment.

A curved slot changes the direction that fluid flows out from the fluid outlet tending to give a flow that is more normal to the surface of the attachment and this improves the hold of the hair around the attachment.

Preferably, the at least one plate is lined with a material. It is preferred that the material absorbs sounds and/or vibrations. Preferably, the material is Kevlar or wool.

It is preferred that the attachment further comprises a flow directing element between the fluid inlet and the fluid outlet. The flow directing element also changes the direction that fluid flows out from the fluid outlet tending to give a flow that is more normal to the surface of the attachment and this improves the hold of the hair around the attachment. In addition, the flow directing element reduces the velocity of the fluid within the attachment which in turn reduces the noise produced by the attachment.

Another aspect of the invention provides an attachment for a hand held appliance comprising a body having a wall, a fluid inlet at one end of the wall and a fluid outlet through the wall wherein the fluid outlet comprises at least one slot extending along the wall wherein the at least one slot is formed by an overlap of a first end of the wall and a second end of the wall and wherein the attachment further comprises a flow directing element between the fluid inlet and the fluid outlet.

Preferably, the flow directing element comprises a perforated layer. It is preferred that the perforated layer is formed from a mesh or weave of an elongate material. Preferably, the elongate material is a wire. It is preferred that the flow directing element extends substantially along the length of the at least one slot. Preferably, the flow directing element extends substantially around an inner circumference of the attachment.

According to a second aspect, the invention provides a hand held appliance comprising a handle having a fluid flow path from a fluid inlet to a fluid outlet and a fan unit for drawing fluid into the fluid inlet and an attachment for attaching to the handle, the attachment comprising a body having a wall, a fluid inlet at one end of the wall which, when the attachment is attached to the handle is in fluid communication with the fluid outlet of the handle and a fluid outlet through the wall wherein the fluid outlet comprises at least one slot extending along the wall and wherein the at least one slot is formed by an overlap of a first end of the wall and a second end of the wall.

Another aspect of the invention provides a hand held appliance comprising a handle having a fluid flow path from a fluid inlet to a fluid outlet and a fan unit for drawing fluid into the fluid inlet and an attachment for attaching to the handle, the attachment comprising a body having a wall, a fluid inlet at one end of the wall which, when the attachment is attached to the handle is in fluid communication with the fluid outlet of the handle and a fluid outlet through the wall wherein the fluid outlet comprises at least one slot extending along the wall wherein the at least one slot is formed by an overlap of a first end of the wall and a second end of the wall and wherein fluid emitted from the fluid outlet flows around the external surface of the wall.

Another aspect of the invention provides a hand held appliance comprising a handle having a fluid flow path from a fluid inlet to a fluid outlet and a fan unit for drawing fluid into the fluid inlet and an attachment for attaching to the handle, the attachment comprising a body having a wall, a fluid inlet at one end of the wall which, when the attachment is attached to the handle is in fluid communication with the fluid outlet of the handle and a fluid outlet through the wall wherein the fluid outlet comprises at least one slot extending along the wall wherein the at least one slot is formed by an overlap of a first end of the wall and a second end of the wall and wherein one of the first end and second end of the wall includes a spacer which defines a thickness of the slot.

Another aspect of the invention provides a hand held appliance comprising a handle having a fluid flow path from a fluid inlet to a fluid outlet and a fan unit for drawing fluid into the fluid inlet and an attachment for attaching to the handle, the attachment comprising a body having a wall, a fluid inlet at one end of the wall which, when the attachment is attached to the handle is in fluid communication with the fluid outlet of the handle and a fluid outlet through the wall wherein the fluid outlet comprises at least one slot extending along the wall wherein the at least one slot is formed by an overlap of a first end of the wall and a second end of the wall and wherein the slot is disposed at an angle of 1-89° to a longitudinal direction of the attachment.

Preferably, the body of the attachment is substantially the same diameter as handle.

Alternatively, the body of the attachment is a different diameter to that of the handle.

Preferably, the attachment has a smaller diameter to handle.

Alternatively, the attachment has a greater diameter to handle.

In one embodiment, the appliance is a hair care appliance.

In one embodiment, the appliance is a hot styling appliance such as a hot styling brush.

BRIEF DESCRIPTION OF THE DRAWINGS

The invention will now be described by example, with reference to the accompanying drawings, of which:

FIG. 2 *a* shows an exploded view of some handle components of an appliance according to the invention;

DETAILED DESCRIPTION OF THE INVENTION

Figure 1A:
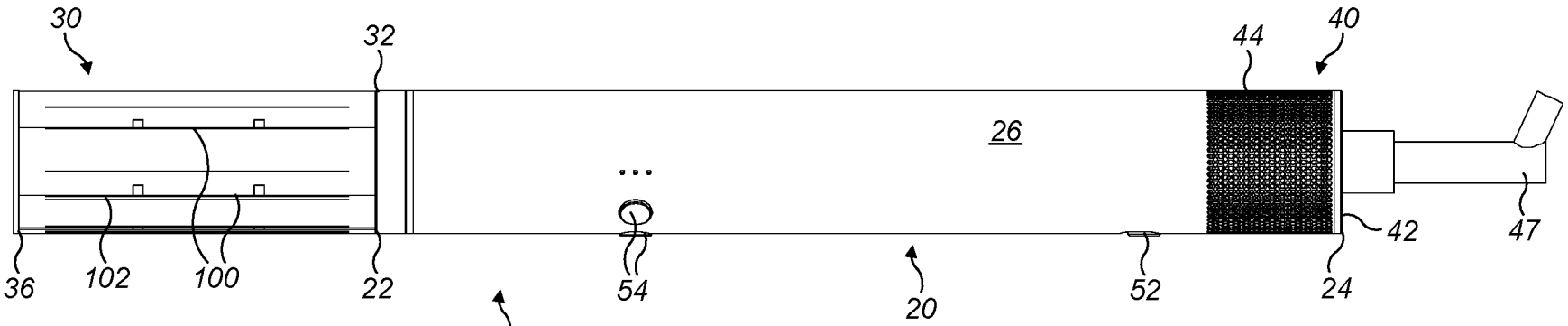
FIG. 1*a* shows an example of an appliance according to the invention.
Figure 1B:
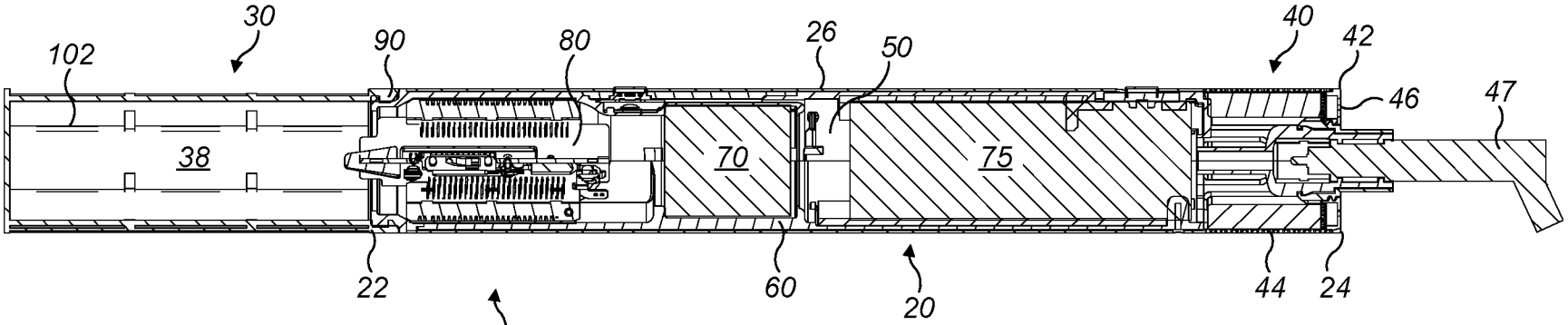
FIG. 1*b* shows a cross section through the appliance shown in FIG. 1*a;*

FIGS. 1*a* and 1*b* shows a hot styling brush 10 with a handle 20 and a detachable head or attachment 30 which is attaches at the distal end 22 of the handle 20 to the fluid inlet 40.

The handle 20 has an outer wall 26 which is generally tubular and includes the fluid inlet 40 at and adjacent one end 24. The fluid inlet 40 comprises a first set of apertures 44 which extend radially around the handle 20 and along the outer wall 26 of the handle from the handle end 24. The handle end 24 is covered by an end wall 42 which is also perforated with a second set of apertures 46 that extend through the end wall 42 of the handle. Thus, the fluid inlet 40 extends around, along and across the handle 20. The end wall 42 is orthogonal to the outer wall 26 and an inner wall 60 of the handle.

The handle 20 also includes a fan unit 70 which comprises a fan and a motor which drives the fan and in use, draws fluid in through the fluid inlet 40, along a fluid flow path 50 which extends through the length of the handle 20. The fluid is optionally heated by a heater 80 before entering an inner cavity 38 of the head 30. A nozzle 23 may be included at distal end 22 of handle 20 to shape fluid flow as it enters the head 30.

The head 30 includes a fluid outlet 100 which in this example comprises parallel slots 102 each extending towards a second end 36 of the head and radially around the head 30. This arrangement enables fluid to exit the head all the way around the head and for the majority of the length of the head 30 maximising a hair styling region of the product.

In use, hair is wrapped around the head 30 whilst air or fluid exits through the slots 102 drying the hair and/or styling the hair into curls or waves. The hair wraps automatically due to the flow of air around the surface of the head 30. The air or fluid can be heated but this is not essential.

Power is provided to the appliance via a power cable 47 which preferably extends from a plug or other power source through the end wall 42 of the handle 20 into the cable mount 45. The handle 20 also houses a PCB 75 which is electrically connected to the cable 48, the fan unit 70 and the heater 80 by internal wiring (not shown). An on/off switch 52 and control buttons 54 are provided and connected to the PCB 75 to allow the user to select one of a range of temperature and flow settings.

Figures 2A, 2B:
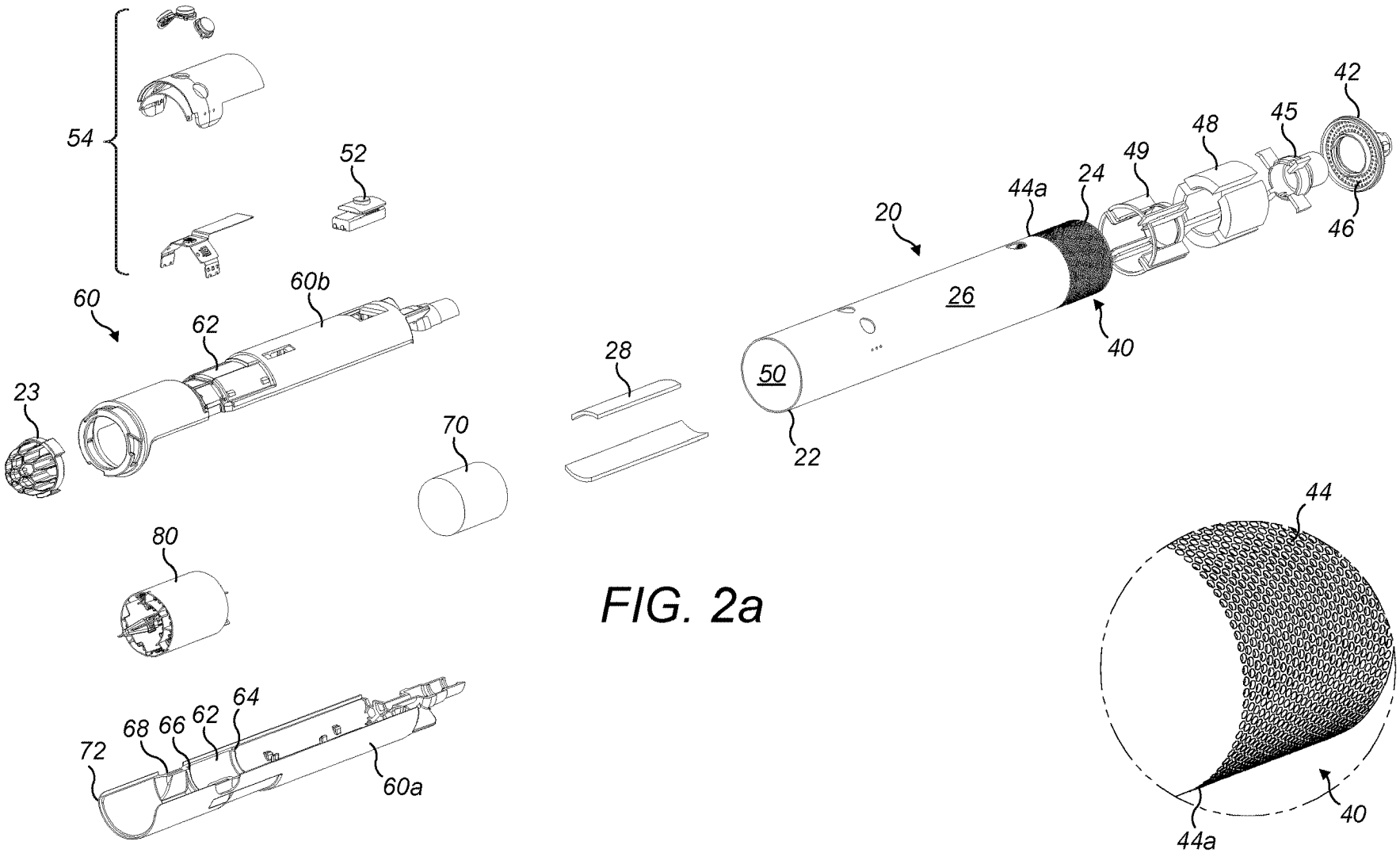
FIG. 2*b* shows an enlarged section of the fluid inlet.

FIG. 2*a* shows an exploded view of various parts of the handle 20 in more detail. The handle 20 is tubular and the outer wall 26 of the handle 20 is a cylindrical sleeve made from for example an extruded tube or rolled sheet of metal such as aluminium, an aluminium alloy or a steel. The handle connects to a head 30 at a first end 22 and at the distal, second end 24 a fluid inlet 40 is provided. The fluid inlet 40 is a first means of filtering fluid that enters the fluid flow path 50.

The fluid inlet 40 comprises a plurality of apertures extending around, along and across the handle 20. Having an inlet that extends in three dimensions has advantages particularly when used with hair grooming appliances. Firstly, if the appliance is placed on a surface whilst switched on only a small part of the inlet surface area will be blocked or have restricted flow of fluid into the appliance. This protects the fan unit and particularly the motor of the fan unit from running with too low a flow rate as this can cause overheating of the motor and cause damage to the motor.

Secondly, often hair care appliances are used with a styling product such as a mousse, gel or spray. These products are typically either applied by a hand or directly to the hair as a mist. After application by a hand, some of the product will be retained on the skin which is then transferred to the appliance when held. This can block at least some of the apertures 44 that extend around and along the handle 20. However, the apertures 46 that extend under the handle and across the end wall 42 of the handle will be unaffected. When a product is applied as a mist, it can settle on the appliance and again block or restrict at least some of the apertures of the fluid inlet 40. However, by having apertures that extend around, along and across the handle 20 the risk of blocking the fluid inlet 40 is reduced.

The apertures are preferably circular with a diameter of 0.2 to 1.6 mm. The diameter of the apertures can vary along, around and across the handle 20. It is advantageous to space the apertures regularly around, along and across the fluid inlet 40. Not only is this visually pleasing but it also has the technical advantage that there is no weak region of the fluid inlet 40 where blockage of a portion is more likely or would have more impact on the flow into the fluid inlet 40. The inlet is designed so that the flow into the inlet is even at least around the circumference of the handle 20.

A foam block 48 is provided which, in use, is inserted into the second end 24 of the handle 20 and may be positioned within the handle 20 by a foam block mount 49. The foam block 48 is a second means of filtering the fluid that passes through the primary fluid inlet 40 into the primary fluid flow path 50. It is advantageous that the foam block 48 extends beyond or further towards the first end 22 of the handle than the primary fluid inlet 40 as this ensures that fluid that has entered the primary fluid inlet 40 has passed through the foam block 48 so has had two stages of filtration. In other words, the foam block 48 extends from the second end 24 of the handle 20 past the downstream end 44*a* of the fluid inlet.

The foam block 48 shown is cylindrical and substantially fills the area within the handle 20 at the primary fluid inlet 40. This is to ensure that all fluid that enters the primary fluid inlet through first apertures 44 that extend around and along the handle and fluid that enters through second apertures 46 that extend across and through the end wall 42 of the handle 20 passes through this second stage of filtration. The foam block 48 extends longitudinally from the second end 24 of the handle 20 further than the first apertures 42 of the primary fluid inlet 40.

The first apertures 44 that extend along and around the outer wall 26 are machined, punched or laser cut from the extruded tube or sheet metal that the outer wall 26 is formed from.

The handle 20 has an outer wall 26 and an inner wall 60, the outer wall 26 slides over the inner wall 60 to form the finished product. The inner wall 60 is a duct which surrounds and defines a fluid flow path 50 through the appliance. The outer wall 26 includes a grippable portion and in these examples, includes the fluid inlet 40 into the fluid flow path 50. An insulting layer of material 28 is provided within the inner wall 60. The insulating layer is a foam or a felt and insulates the handle from noise produced by the fan unit 70, heat produced by the operation of the appliance, vibrations caused by the fan unit and noise produced within the appliance by the flow of fluid through the fluid flow path 50. The insulating layer absorbs energy including airborne noise.

The inner wall 60 provides a housing 62 in which a fan unit 70 is disposed. The housing 62 is cylindrical and has an inwardly protruding ledge 64,66 disposed one at each end of the housing 62 which maintain the position of the fan unit 70 within the handle 20. The inner wall 60 is made from two parts a first part 60*a* and a second part 60*b* which is moulded separately. This enables easier assembly of the fan unit 70 within the handle 20 than a one piece inner wall. A similar pair of inwardly protruding ledges 68, 72 maintains the position of the heater 80 within the handle 20.

Although the outer wall 26 of the handle 20 has been described as being made from an extruded tube or a rolled sheet of metal, alternatives methods of manufacture and materials could be used; these include, but are not limited to, a plastic extrusion/moulded tube or a composite tube such as carbon fibre reinforced plastic.

The fluid outlet 100 of the head 30 will now be described in more detail, referring in particular to FIGS. 3*a*, 3*b*, 4*a*, 4*b*, 5*a* and 5*b*. The head 30 is essentially cylindrical and has a first end 32 for connection to a handle 20 and a second end 36 distal to the first end 32. The head 30 extends longitudinally from the first end 32 to the second end 26 continuing a line described by the handle 20 (FIG. 1*a*) so is approximately the same diameter as the handle. Within the head 30 is an inner cavity 38 and fluid that has been drawn into the fluid flow path 50 within the handle 20 by the fan unit 70 enters the inner cavity 38 via an aperture 302 in the first end 32 of the head 30.

The fluid outlet 100 is formed from a number of parallel slots 102 which extend along the length of the head 30 from the first end 32 to the second end 36. The slots 102 are formed from an overlap 120 (FIG. 5*b*) formed between adjacent plates 110 which results in fluid being directed between a radially inner surface 104 formed from the outer surface 112 of a first plate 110*a* and a radially outer surface 106 formed from the inner surface 114 of a second plate 110*b*. The fluid 122 flowing out of the slot 102 is tangential 130 to the outer surface 112 of the plate 110*a* and joins with the fluid flowing out of the other slots of the fluid outlet 100 forming a fluid flow around the circumference of the head 30. Thus, the fluid 122 is blown out along the external surface of the head and this encourages hair to wrap around the head 30 automatically.

The fluid 122 exiting the slots 102 is attracted to the curved surface of the head 30 by the Coanda effect. This in turn causes hair that is presented to the head 30 to automatically wrap around the surface and then styled into curls. As air is blown down the length of the hair, wet hair is dried more quickly than conventionally and as the wrapping process occurs without the use of bristles, the hair can slide off the head 30 once it is dry or styled so there is no tangling.

To maintain the size of each slot 102, spacers 108 are provided. In this example, a pair of spacers 108 is provided to maintain each slot 102 size. Each one of the pair of spacers 108 is longitudinally spaced along the slot 102 and the plate 110. The spacers 108 join adjacent plates 110 together.

Figure 3A:
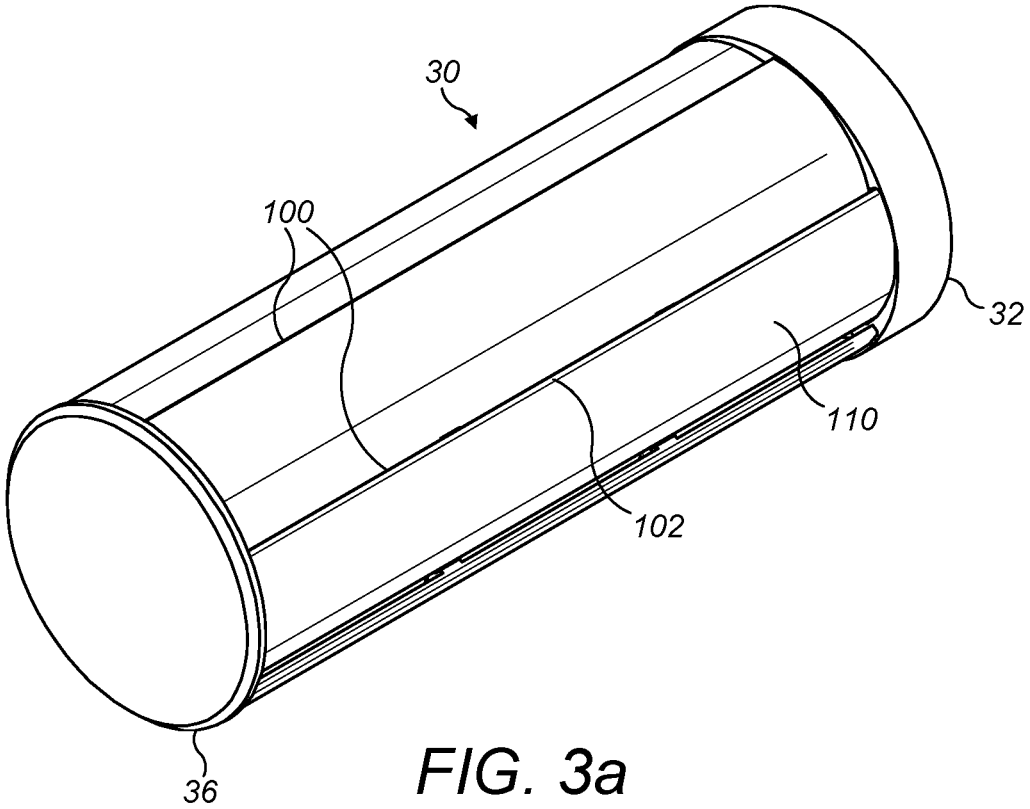
FIGS. 3*a* and 3*b* show an isometric view and an isometric cross section through a first attachment according to the invention.
Figure 3B:
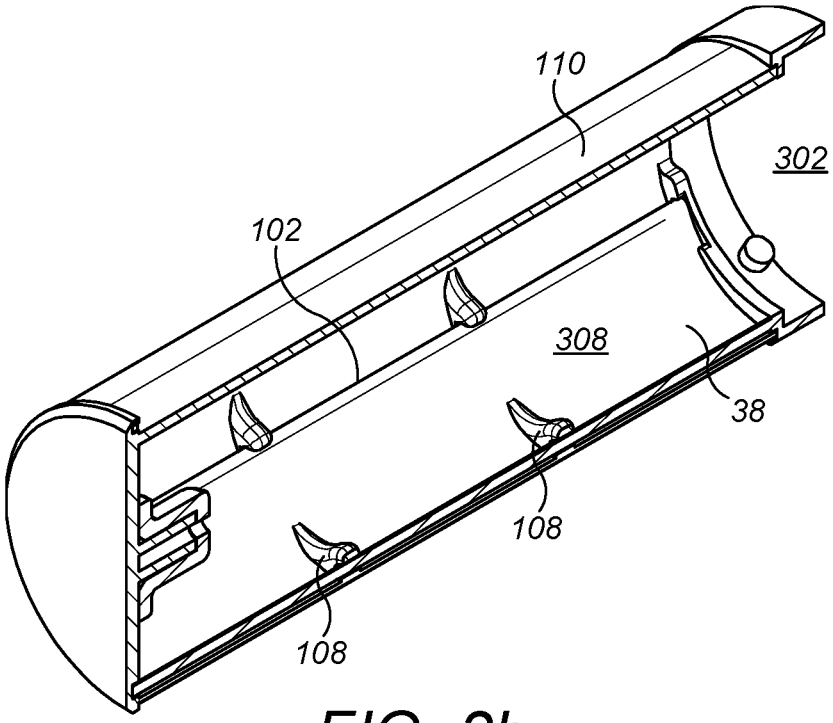
Figure 4A:
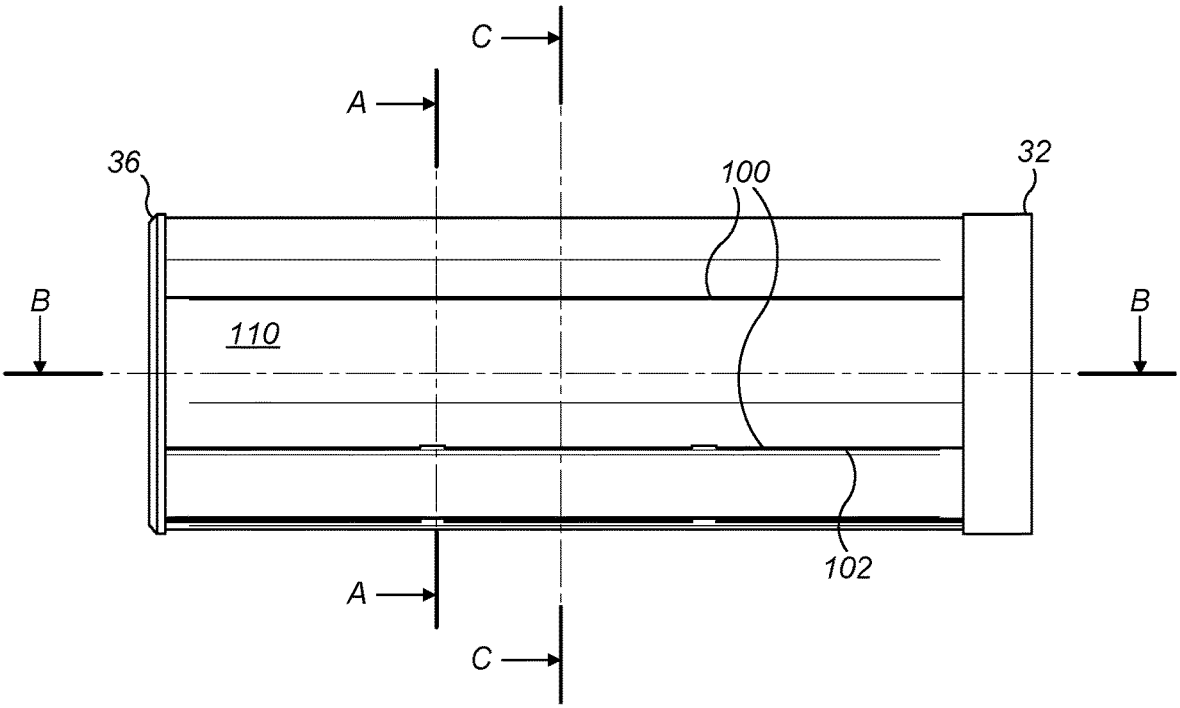
FIGS. 4*a* and 4*b* show a side view and a side view cross section through the first attachment.
Figure 4B:
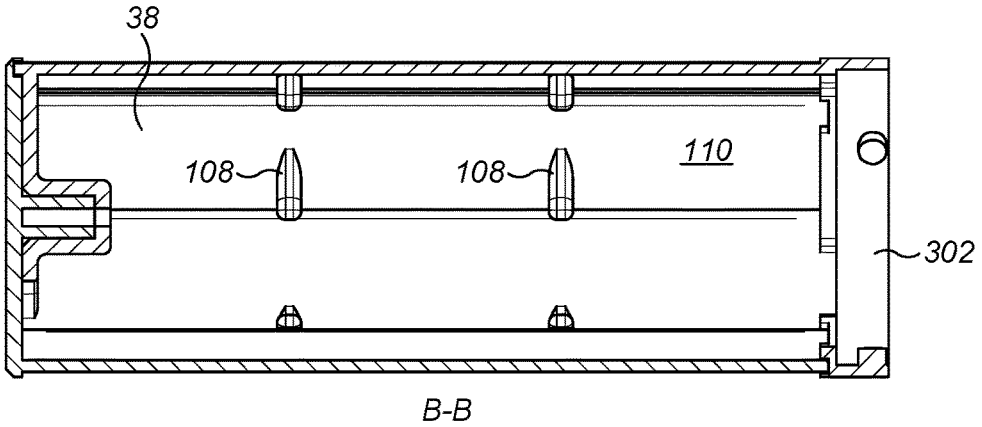
Figure 5A:
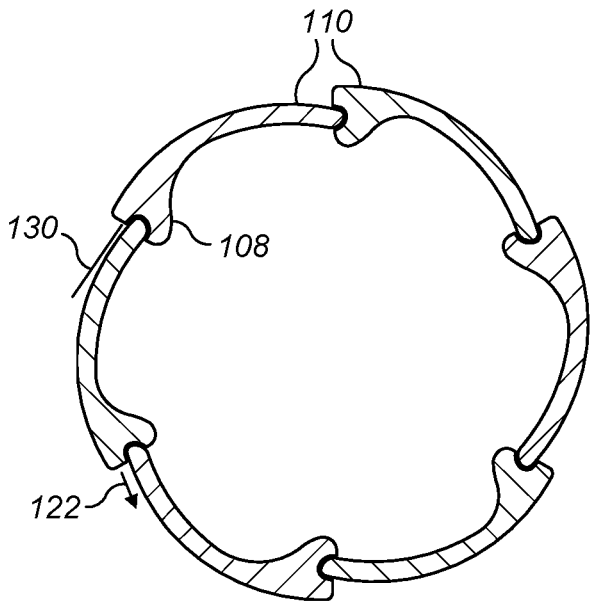
FIGS. 5*a* and 5*b* show cross sections through the first attachment.
Figure 5B:
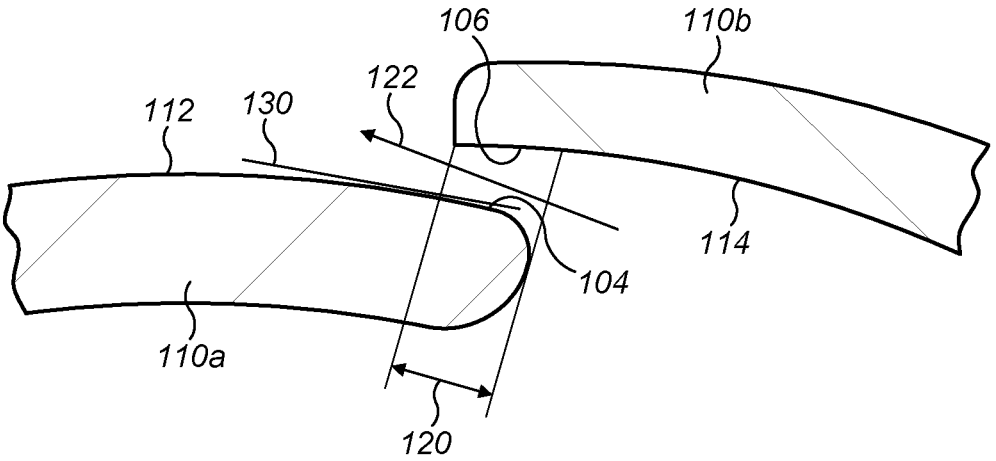

Advantageously, each plate 110 is lined with a felt like material 308 such as Kevlar or wool (see FIG. 3*b*). The material 308 does not extend over each slot 102 so the fluid exiting the fluid outlet 100 does not pass through the layer of material 308. This layer serves to absorb some of the noise produced by the fluid flowing through the head 30 from the inlet to the head 30 at aperture 302 to the fluid outlet 100. Such a layer of material 308 is as applicable for other heads herein described such as heads 130, 180 and 230.

Figure 6A:
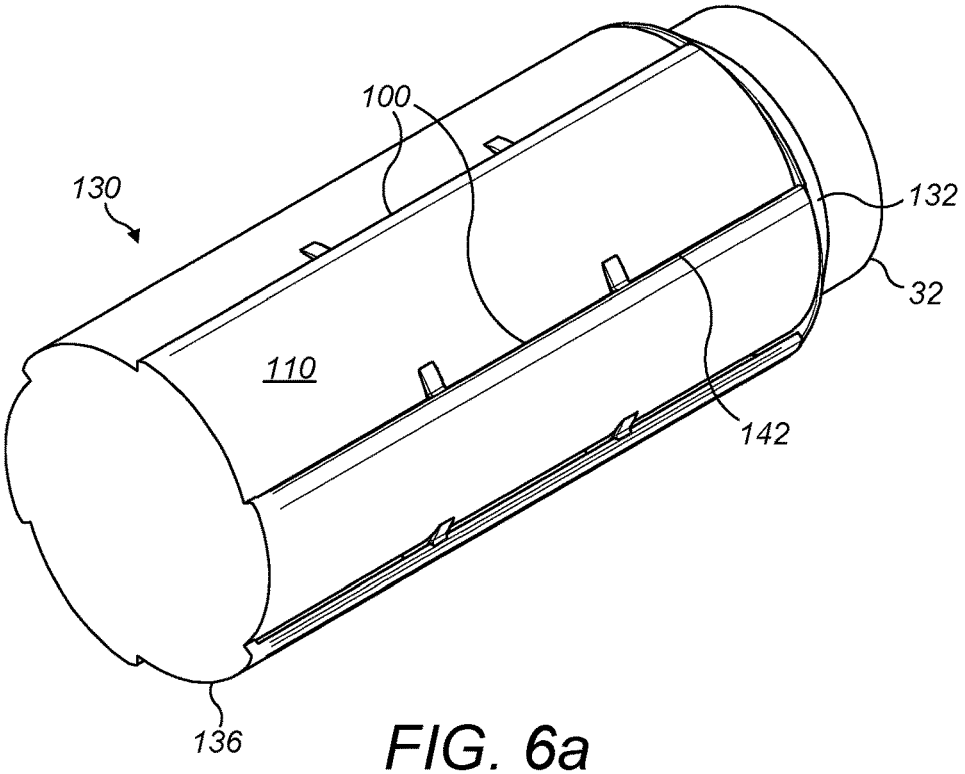
FIGS. 6*a* and 6*b* show an isometric view and a side view through a second attachment.
Figure 6B:
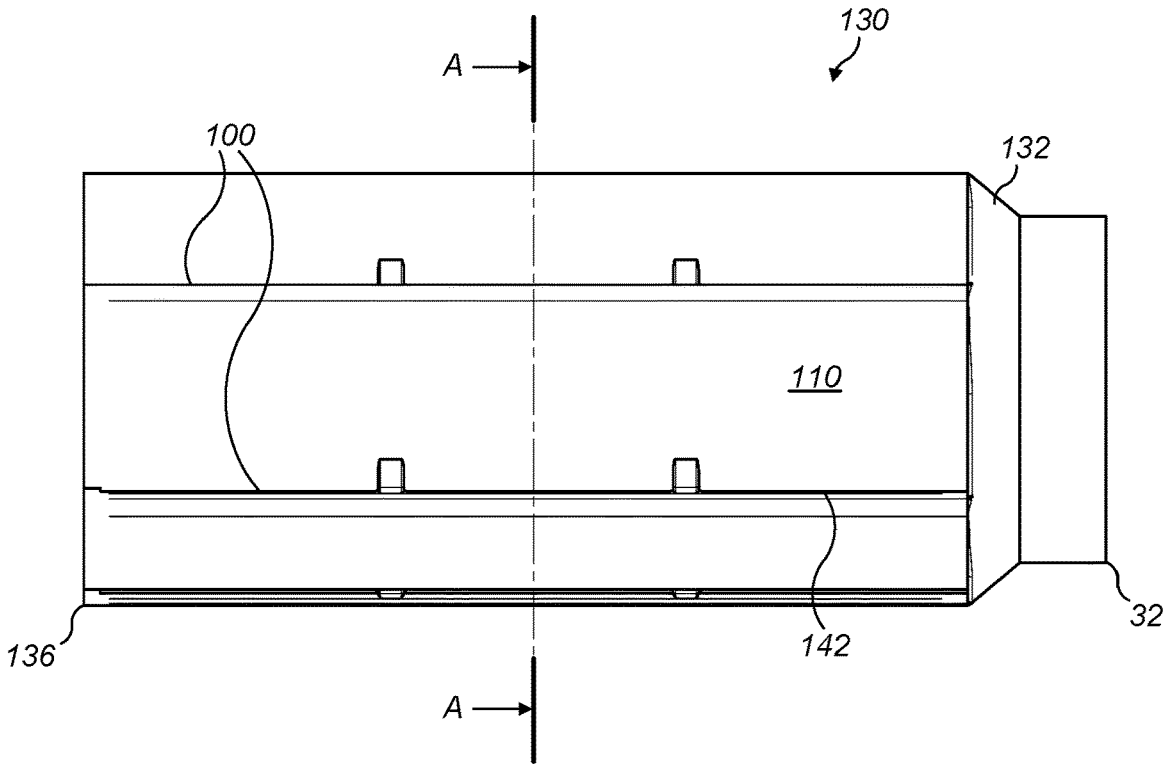

FIGS. 6*a* and 6*b* show an alternative head 130, all features identical to those previously described have the same reference numerals. The head 130 has a larger diameter than the handle 20 so is used to create larger curls. The head 130 has a first end 32 for connection to the handle 20 and this is the same diameter as the handle 20, within a collar 132 of the head 130, the diameter of the head 130 increases to the larger diameter prior to the fluid outlet 100 formed by slots 142 and then continues at a constant diameter to the second end 136. An inner fluid cavity (not shown) is larger than for the head 30 of FIG. 3*a*. In this example the number of plates 110 and slots 102 is the same i.e. six as for the head described with respect to FIG. 3*a*. Alternatively, a larger or smaller number of plates 110 and slots 142 could be used.

Figure 7A:
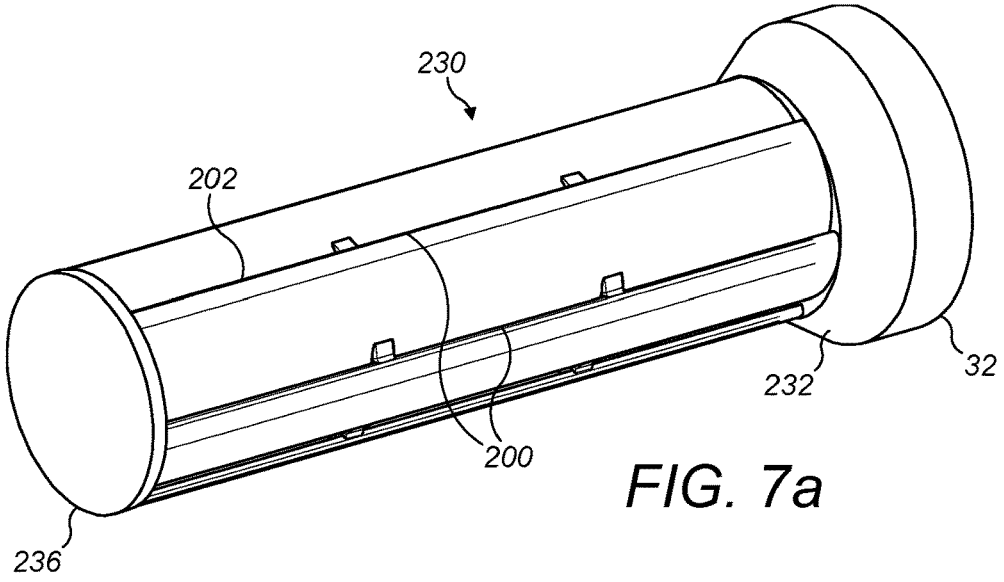
FIG. 7*a* shows an isometric view through another attachment.

FIG. 7*a* shows a further head 230. This head 230 has a reduced diameter compared with the handle 20. The first end 32 is substantially the same diameter as the handle 20 for connection thereto, and then within a collar 232 the diameter of the head 230 decreases to the reduced diameter prior to the fluid outlet 200 formed by slots 202 and continues at a constant diameter to the second end 236. This head 230 is used to create tighter curls.

The slots 202 for this head extend longitudinally straight from the first end 32 to the second end 236 as was the case for slots 102 in heads 30, 130.

Figure 7B:
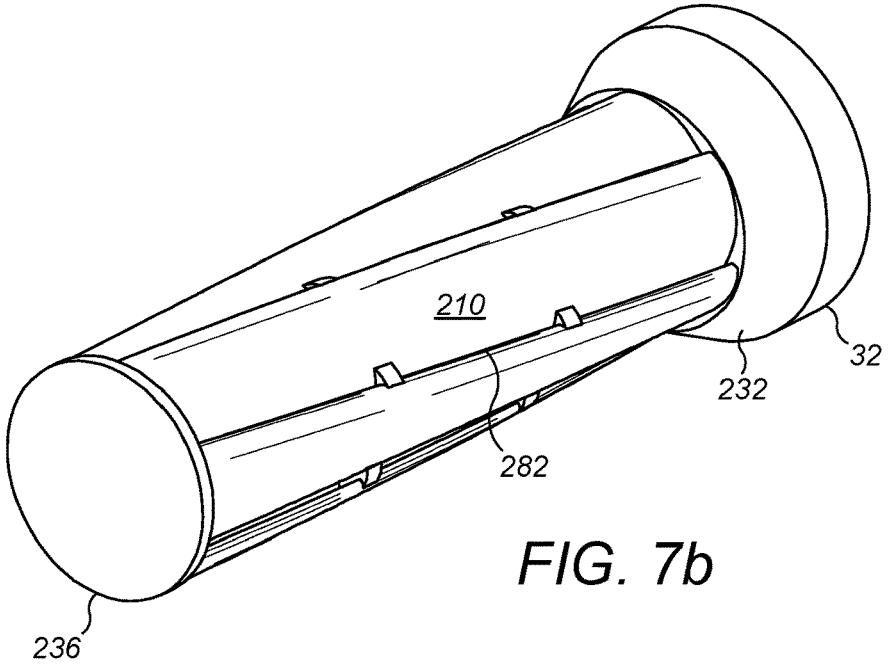
FIGS. 7*b* and 7*c* show an isometric view and a side view through a further attachment.
Figure 7C:
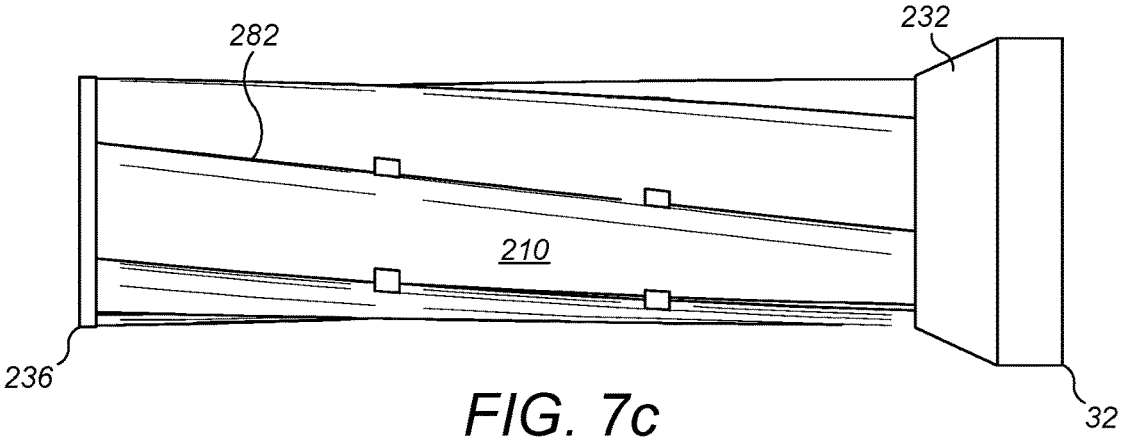

In another embodiment, as shown in FIGS. 7*b* and 7*c*, a further head 280 has slots 282 which curve around the head 280 forming a spiral or helical pattern around the head 280. The slots 282 curve by an angle $\alpha$ of 45° from the longitudinal axis A-A of the handle 20 and head 280. In this example the slots 282 curve in a clockwise direction from the first end 34 of the head 280 towards the second end 236 of the head. The slots 282 are formed as before between adjacent overlapping plates 210 however, in order to form the curved slots 282, the plates 210 do not extend along the longitudinal axis of the head 280 but also curve by an angle of 45°. Using angled slots changes the profile of the fluid exiting from the head. The airflow exiting from the slots is more normal to the slot when angled slots are used. This has benefits including enabling more hair to be wrapped around the head also, the hair is retained on the head more easily leading to a potentially quicker styling process.

The slots can be curved in a clockwise or and anticlockwise direction from the longitudinal axis A-A of the handle 20. Whilst an angle of 45° has been illustrated, improved wrapping is seen even at an angle of 1°.

Figure 8A:
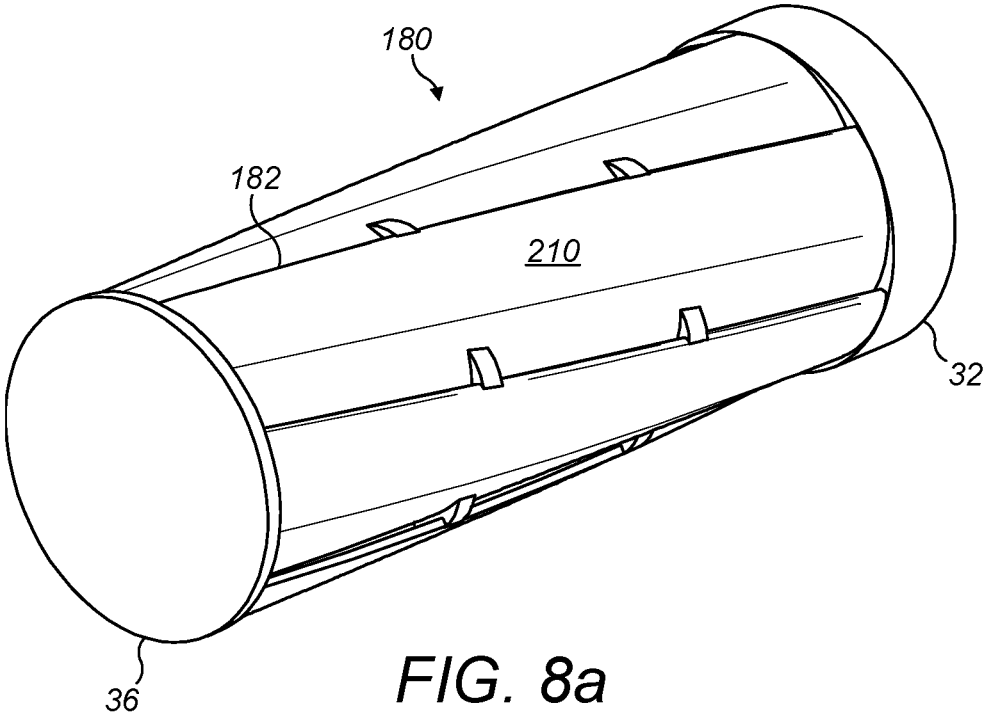
FIG. 8*a* shows an isometric view of a fifth attachment.

FIG. 8*a* shows a head 180 which is substantially the same diameter as the handle 20. The slots 182 are curved or spiral around the head 180 in the same manner as head 280.

Figure 8B:
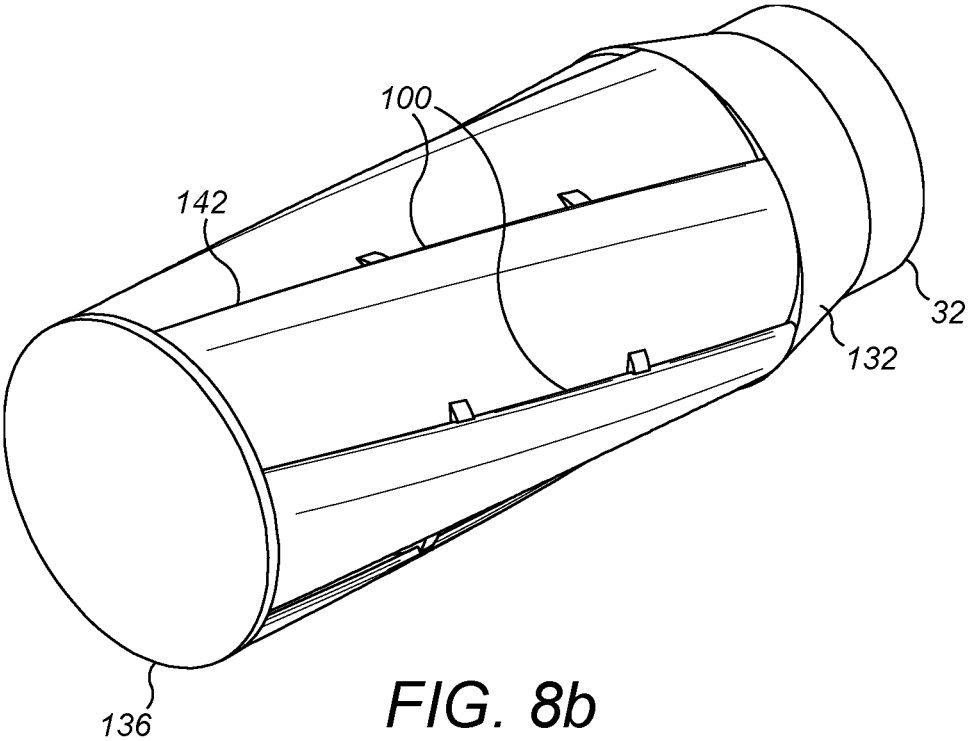
FIG. 8*b* shows an isometric view of a sixth attachment.

FIG. 8*b* shows a head 380 which has a larger diameter than the handle, and is similar to head 130 except it has curved or spiraling slots 382 around the head 380.

Figure 9A:
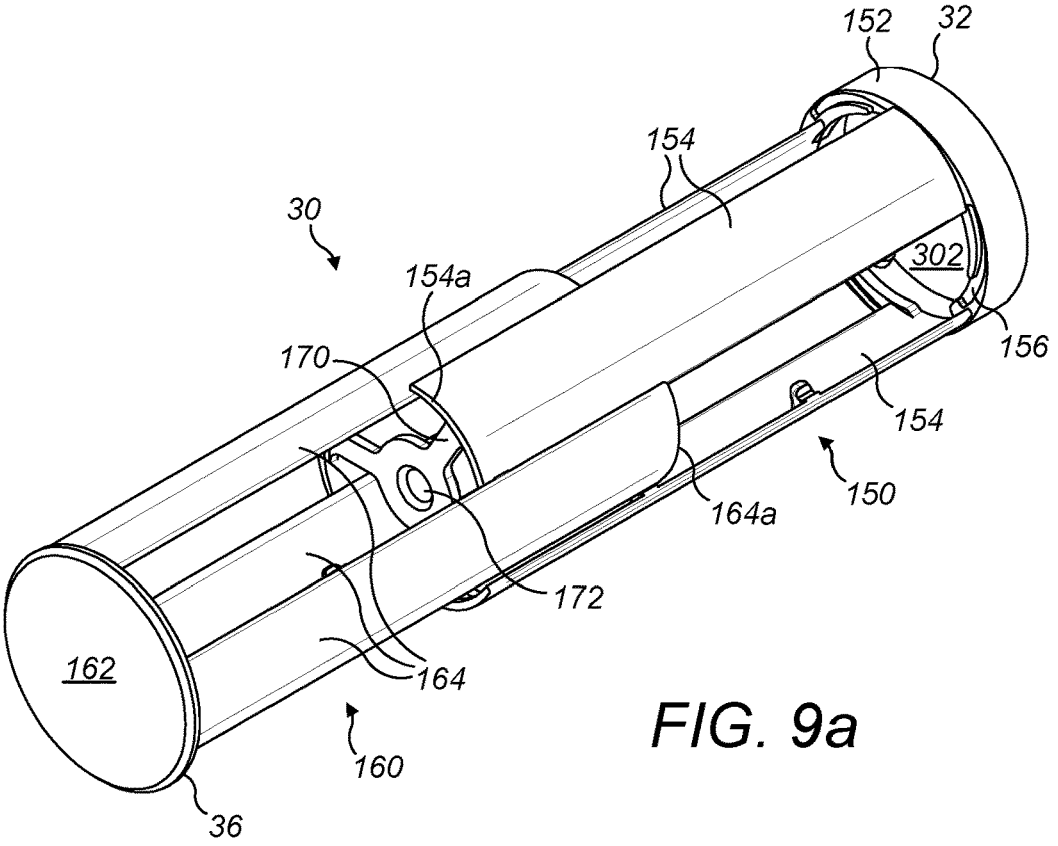
FIGS. 9*a* and 9*b* show isometric views of a two part assembly for an attachment.
Figure 9B:
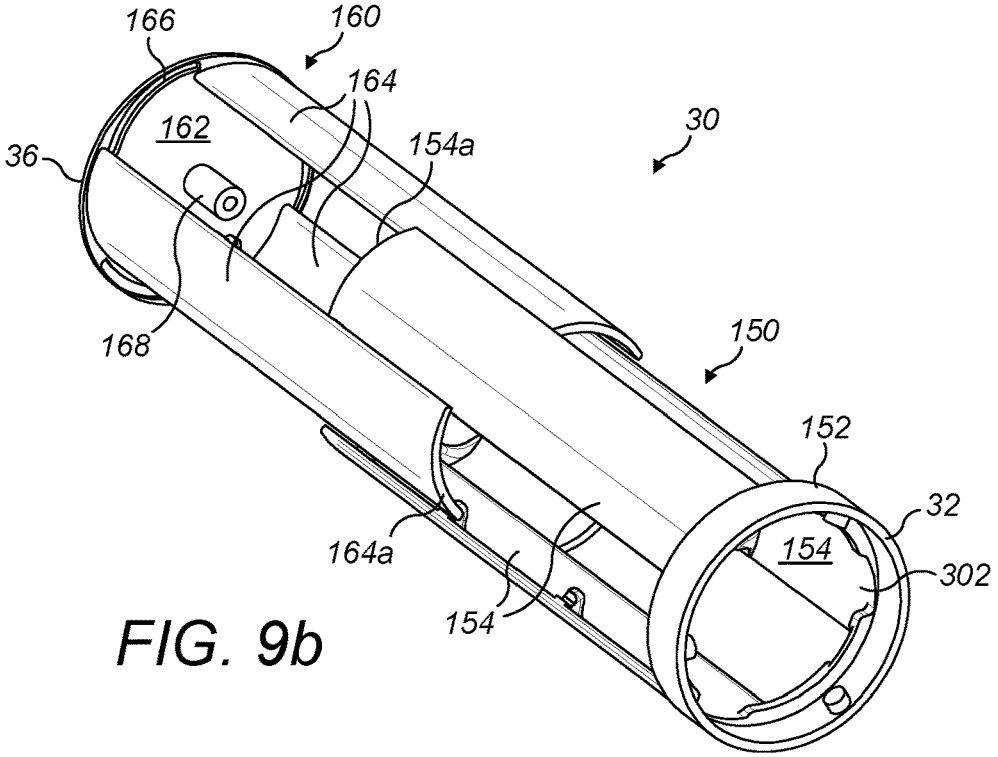
Figure 10A:
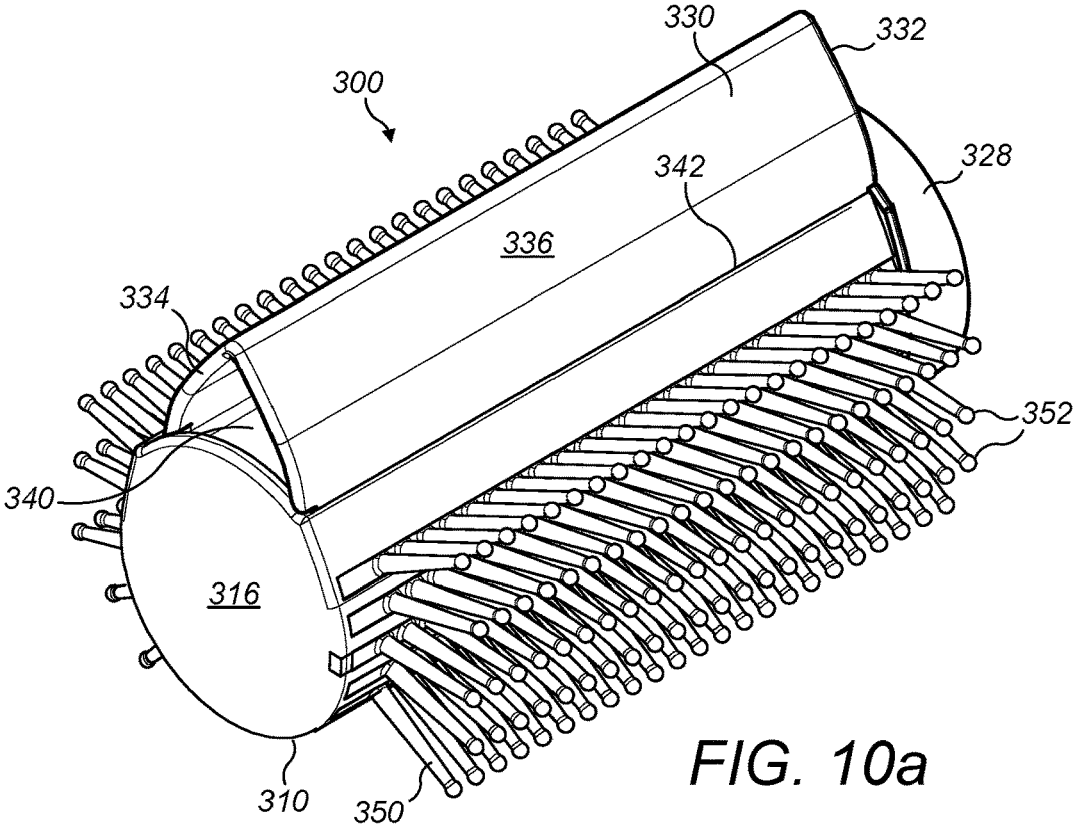
FIGS. 10*a* and 10*b* show an isometric view and an isometric cross section through a further attachment according to the invention.
Figure 10B:
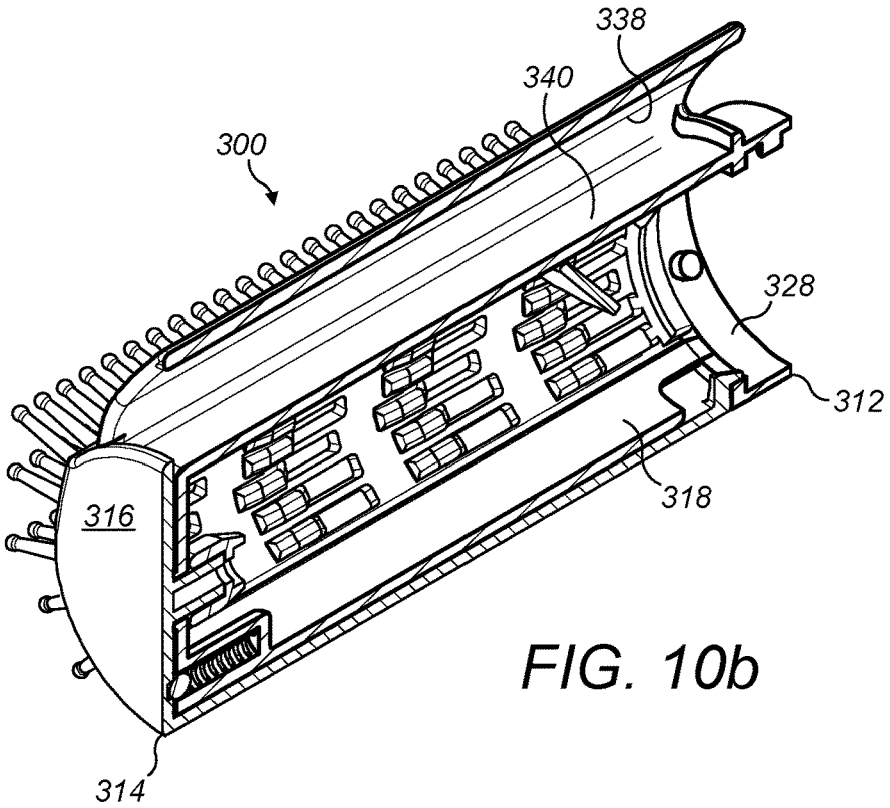
Figure 11A:
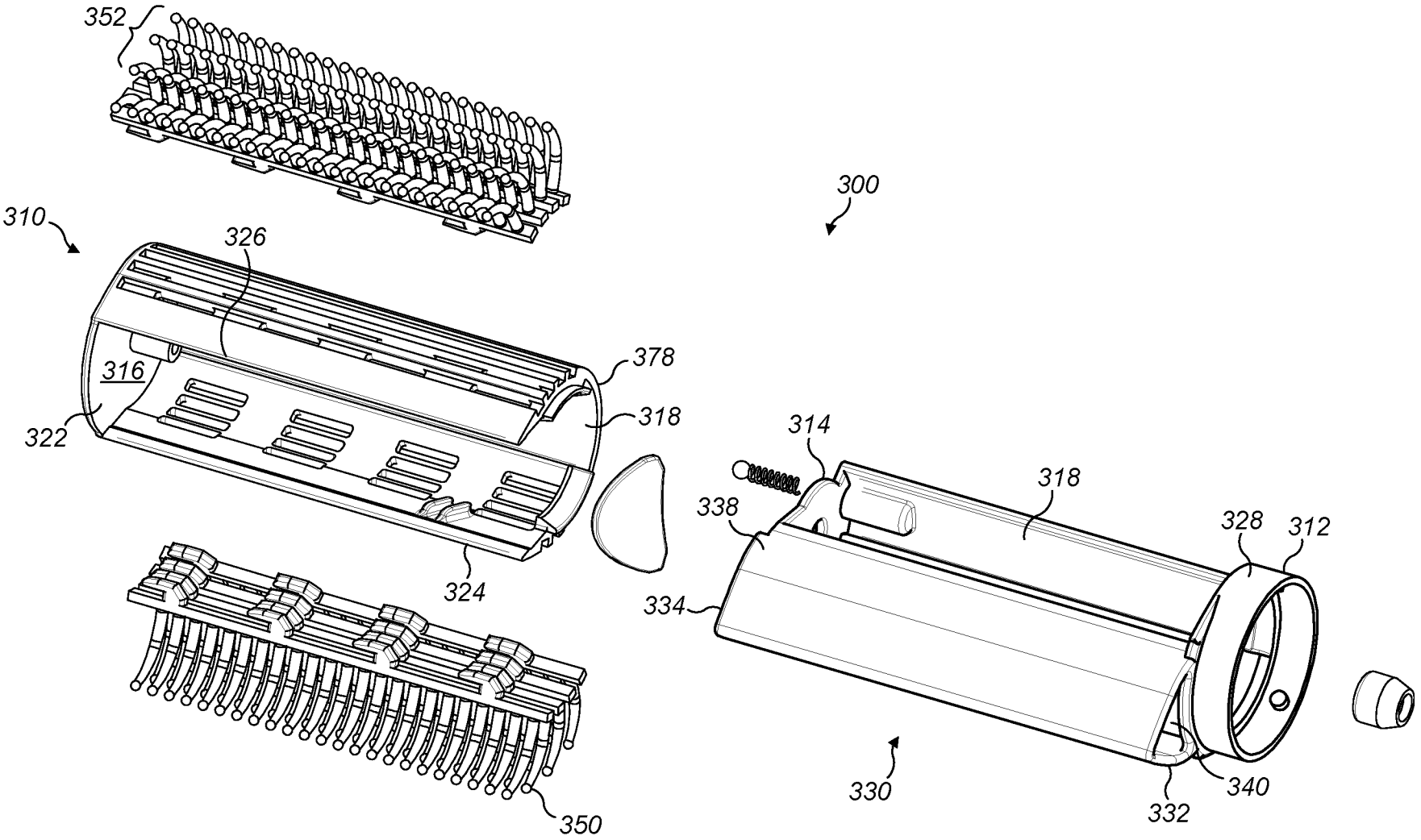
FIGS. 11*a*, 11*b* and 11*c* show a side view and a side view cross sections through the further attachment.
Figure 11B:
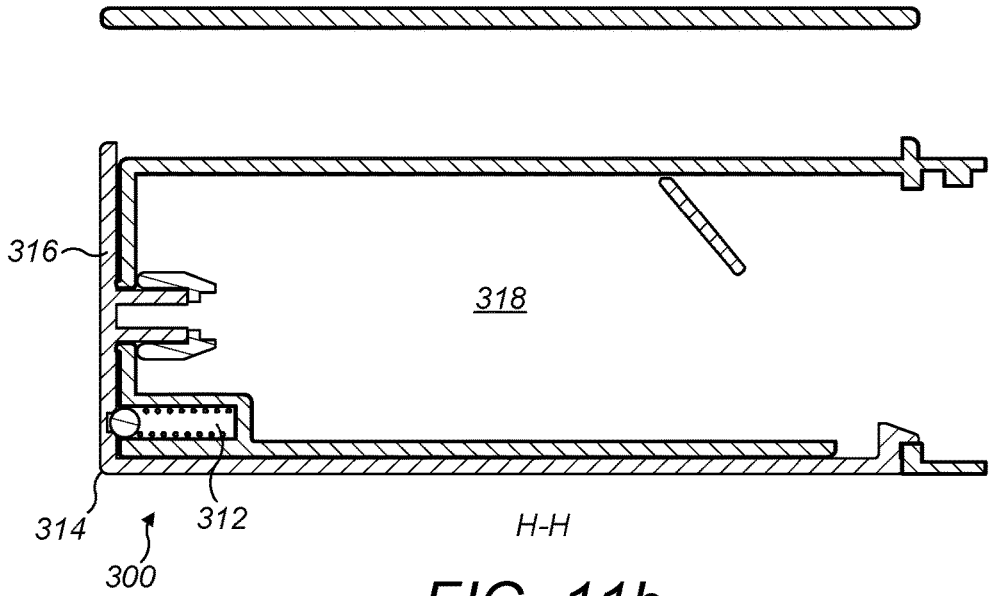
Figure 11C:
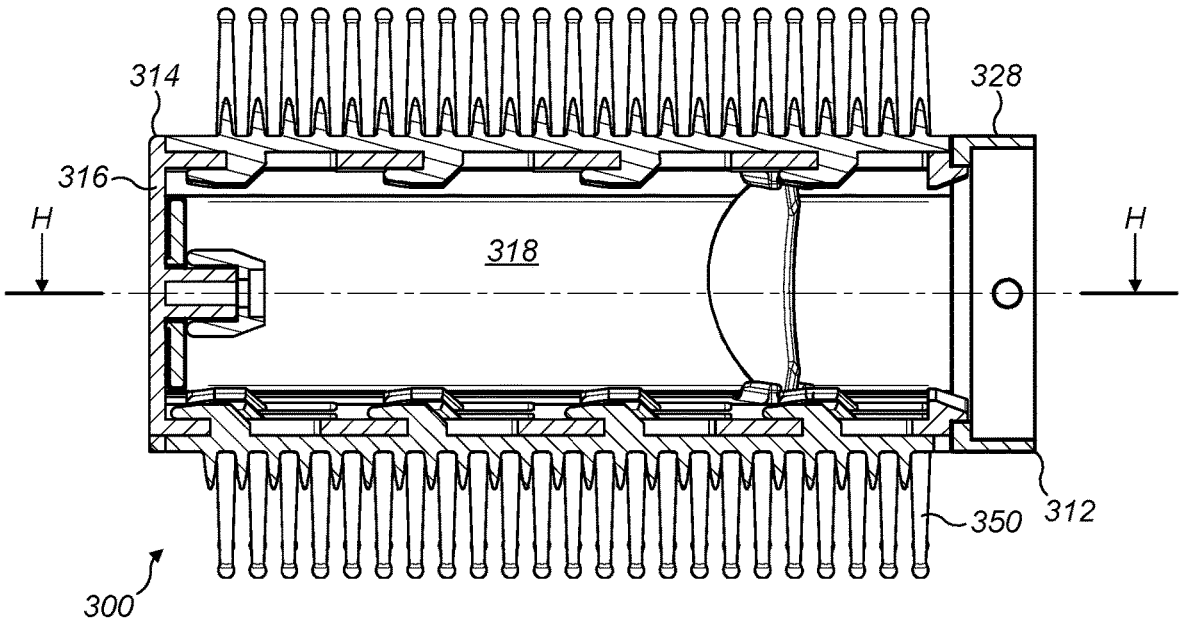

FIGS. 9*a* and 9*b* show a way of assembling head 30. A first part 150 is formed from the first end 32 and has a collar 152 and a first set of plates 154 which are joined to or formed integrally with the collar 152. A second part 160 is formed from the second end 36 and has an end wall 162 and a second set of plates 164 which are joined to or formed integrally with the end wall 162. The first set of plates 154 and second set of plates 164 each comprise non-adjacent plates 110 enabling the first part 150 and the second part 160 to be slotted together to form the head 30. Between each of the first set of plates 154, a recess 156 is provided in the connecting ring 152 adapted to accommodate the distal end 164*a* of the second set of plates 164 from the end wall 162. A similar set of recesses 166 is provided in the end wall 162 and is adapted to accommodate the distal end 154*a* of the first set of plates from the collar 32.

In order to retain the first part 150 and the second part 160 of the head 30 in the assembled condition, a protruding screw hole 168 is provided. Near the distal end 154*a* of the first set of plates 154 a support scaffold 170 is provided and this has two functions. A first function is to support the first set of plates 154 and maintain their relative positions towards the distal end 154*a* and a second function is to provide part of the fixing mechanism. In this example, the support scaffold 170 has a central aperture 172 through which the protruding screw hole 168 passes on assembly of the head 30*a* and a screw, for example can be inserted to fix the two parts 150, 160 of the head together.

FIGS. 15*a*, 15*b*, 15*c*, 15*d* and 15*e* show a head 400 all features identical to those previously described have the same reference numerals. This head 400 has a reduced diameter compared with the handle 20. The slots 102 extend longitudinally from the first end 32 to the second end 236, however the slots could be curved as described with respect to FIGS. 7*a* and 7*b*.

Figure 16A:
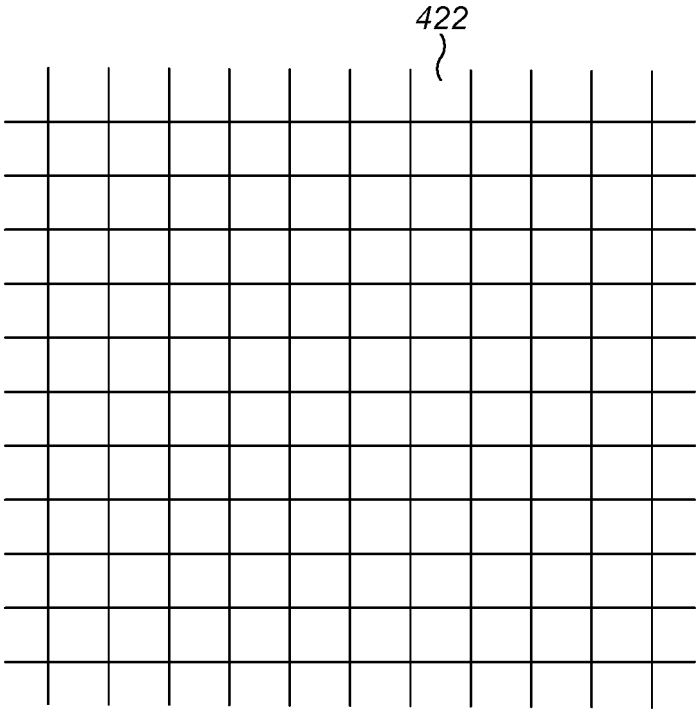
FIGS. 16*a* and 16*b* show an alternative sock for the other attachment.
Figure 16B:
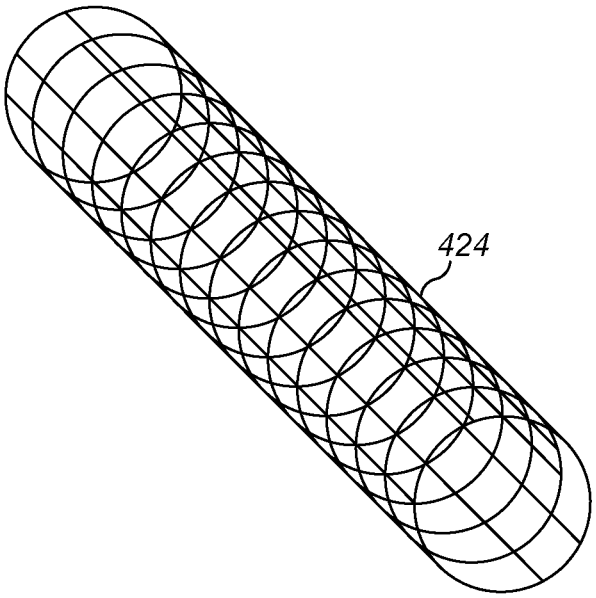

Internal of the head 400, within the cavity 418 formed within the head 400, an internal sock 420 is provided. This sock 420 is a mesh formed from a metal wire. The sock 420 can be in the knitted form 426 shown in FIG. 15*b*. Alternatively as shown in FIGS. 16*a* and 16*b* the sock 420 is a tube 424 formed from a woven mesh 422 having generally square apertures.

The sock 420 diffuses the fluid flowing in the cavity 418 within the head 400 and slows down the longitudinal velocity of the flow. This results in more even wrapping of hair around the head 400 as the direction of fluid exiting the head 400 is more normal to the slots 102. The sock 420 extends along the length of the slots 102 within the head 400. The size of the apertures in the mesh is important; if they are too small the flow becomes too restricted and there is an increased chance of them clogging over time. An aperture size of around 1.6 mm has been found to provide the benefit without undue restriction.

FIGS. 10*a*, 10*b*, 11*a*-11*c* and 12 show various views of another head 300 which has a directed fluid flow. The head 300 has a first cylindrical part 310 and a second triangular part 330 that together form the fluid outlet 320.

The second triangular part 330 has a first end 312 for connection to a handle 20 via a collar 328 and extends longitudinally to a second end 314 The first cylindrical part 310 has an aperture 322 extending from a first end 378 to a second end which is defined by end wall 316. The aperture 322 is defined by a first edge 324 and a second edge 326. An inner cavity 318 is formed within the head 300 when the second triangular part 330 is slid into the first cylindrical part 310. The first end 278 of the first cylindrical part 310 abuts a downstream end of the collar 328 and the second end 314 of the second triangular part 330 abuts the end wall 316 when the attachment is formed.

The second triangular part 330 has a first end 332 and a second end 334 and if formed from a first side 336, a second side 338 and an internal wall 340. The second triangular part 330 fits within the aperture 322 and extends outwardly beyond the first cylindrical part 310.

The second triangular part 330 is movable relative to the first cylindrical part 310. In this example, the second triangular part 330 is fixed with respect to the handle 20 and the first cylindrical part 310 is moveable relative to both the second triangular part 30 and the handle 20. This enables the outlet slot 342 to be partially defined by one or the other of the first edge 324 and the second edge 326.

Figure 12A:
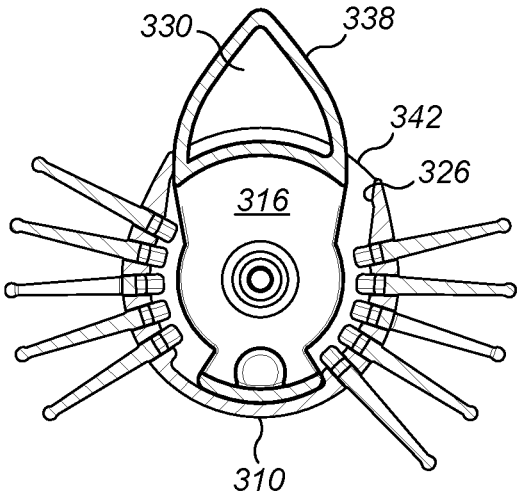
FIGS. 12*a* and 12*b* show cross sections through the further attachment in a first position.
Figure 12B:
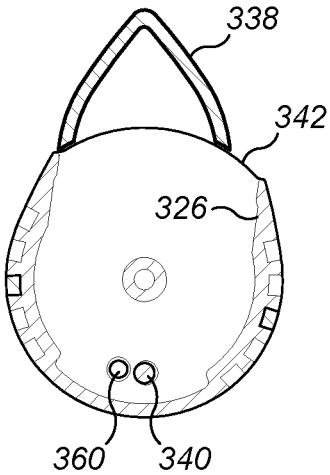
Figure 13A:
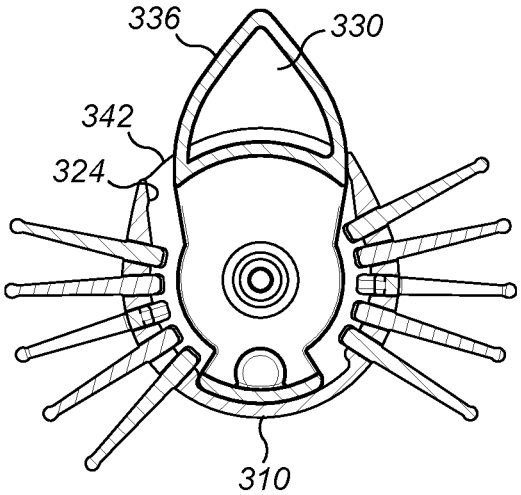
FIGS. 13*a* and 13*b* show cross sections through the further attachment in a second position.
Figure 13B:
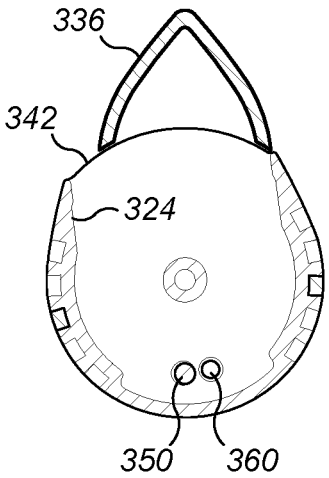

In one position, referring now to FIGS. 12*a* and 12*b*, the first edge 324 along with a first side 336 of the second triangular part 330 define the limits of the outlet slot 342. The second triangular part 330 moves with respect to the first cylindrical part 310 so the outlet slot 342 is alternatively defined by the second edge 326 and the second side 338 as shown in FIGS. 13*a* and 13*b*.

The second triangular part 330 rotates with respect to the first cylindrical part 310 in order to change the position of the outlet slot 342. The first cylindrical part 310 is temporarily retained in a position by the use of a detent mechanism.

The end wall 316 of the first cylindrical part 310 includes a first recess 340 and a second recess 350 each of which adapted to partially accommodate a ball bearing 360. The ball bearing 360 is biased towards the end wall 316 by a spring 362 (see FIG. 11*b*). There are a number of suitable alternatives that could be used instead of this method of retaining one part with respect to the other part such as a plastic bump feature or a piece of sprung metal.

Referring now to FIGS. 12*a* and 12*b*, when the second triangular part 330 is in a first position with respect to the first cylindrical part 310, the outlet slot 342 is formed from first side 336 and first edge 324 and the ball bearing 360 is accommodated by the first recess. By manually rotating the second triangular part 330 with respect to the first cylindrical part 310 the force of the spring 362 retaining the ball bearing 360 within the first recess 340 is overcome and the second triangular part 330 can be rotated with respect to the first cylindrical part 310 to move the ball bearing 360 into the second recess 350 and changing the position of the outlet slot 328 so it is now formed from the second edge 326 and the second side 338.

The first cylindrical part 310 includes bristles 350 arranged in this example in parallel rows 352 on either side of the aperture 322. The rows 352 of bristles 350 extend from near the outlet slot 342 around the head 300 but in this example the bristles 350 do not extend all the way around the head 300, there is a gap in the rows 352 diametrically opposite the outlet slot 320.

Figure 14:
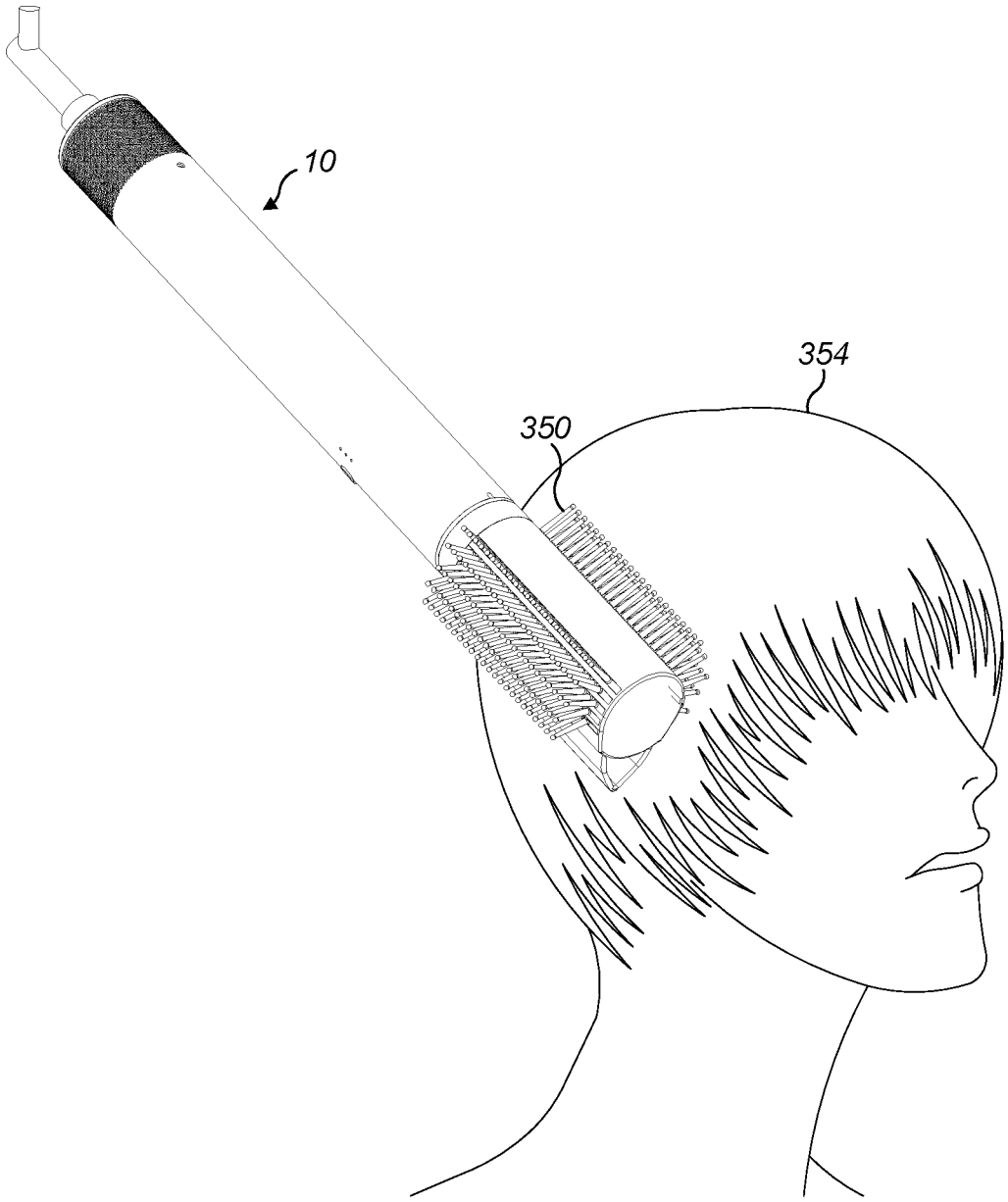
FIG. 14 shows schematically the further attachment in use.
Figure 15A:
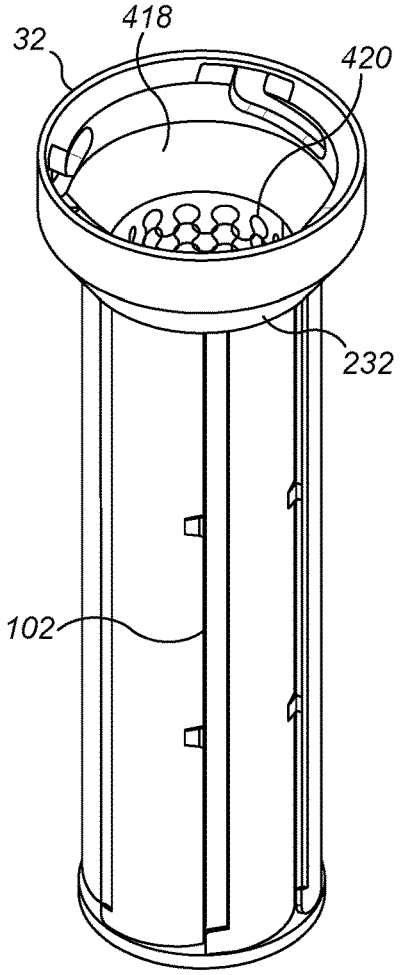
FIG. 15*a* shows an isometric view of another attachment.
Figure 15B:
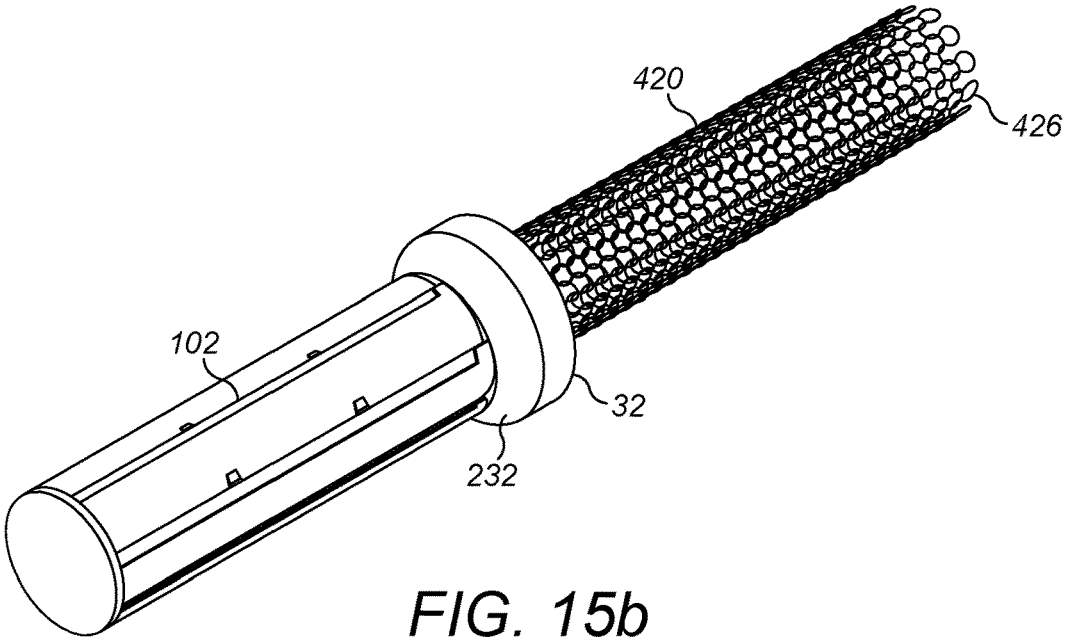
FIG. 15*b* shows different component parts of the other attachment.
Figure 15C:
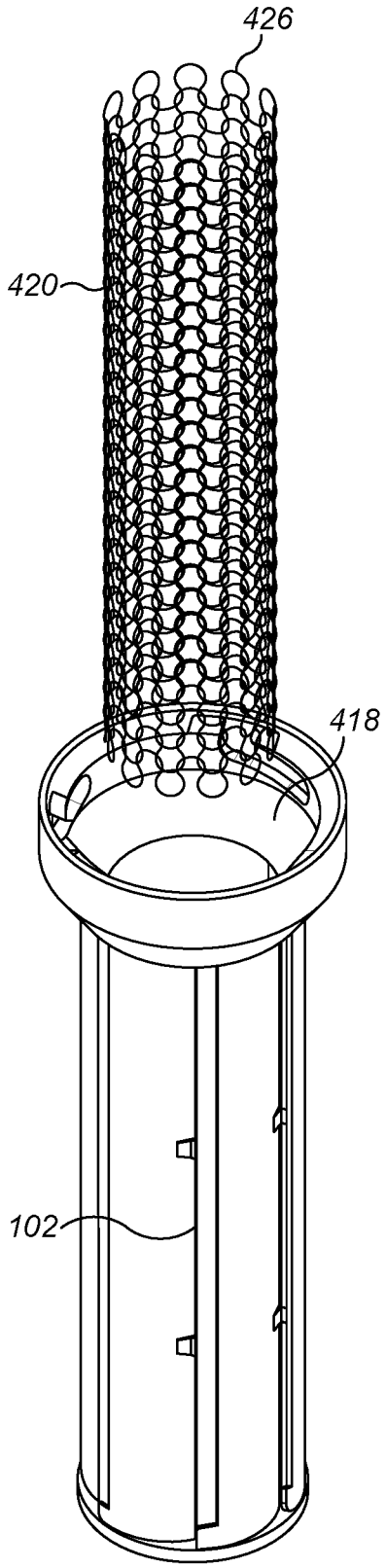
FIG. 15*c* shows the different component parts from the inlet end.
Figure 15D:
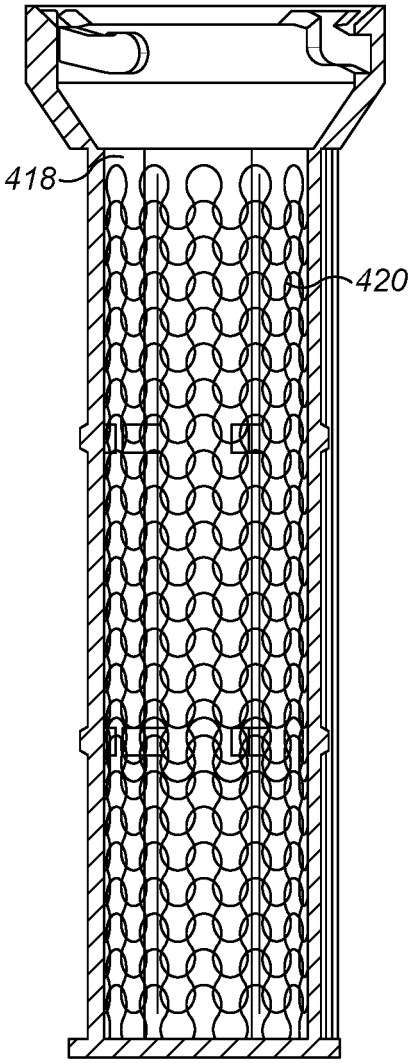
FIG. 15*d* shows a cross section through the side of the other attachment.
Figure 15E:
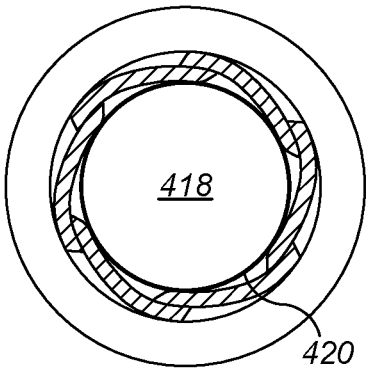
FIG. 15*e* shows a cross section through the other attachment.

Referring now to FIG. 14, when hair 354 is being styled, the action of drawing the bristles 350 down through the hair 354 opens the outlet slot 342 on the side next to the hair 354. The position of the outlet slot 342 is movable by hand or by the friction or force of combing through the hair.

The use of a combination of a directed outlet slot 342 and bristles 350 means that the hair is dried and/or styled more quickly than conventionally as the fluid exiting from the outlet slot 342 is blown down the hair 354. The fluid exiting the outlet slot 342 is attracted to the surface of the second triangular part 330 which in turn attracts the hair 354 to the second triangular part 330. The bristles 350 separate and detangle individual strands of the hair 354 and this combination gives fast drying and a smother result.

In use as shown in FIG. 14, this head is designed to be pulled through the hair with the slot 328 adjacent the hair 354. Fluid is blown out of the slot 328 as the appliance is moved along the hair 354 so the hair is both heated and brushed. Having the slot 328 on either side of the head 356 means that the same head 300 can be used for both sides of the head and both the underside and the topside of the hair 354.

In each of the examples given, the head 30, 130, 180, 230, 300 in connected to handle 20 via a collar and a twist lock joint. Referring to FIG. 7*b*, three protrusions 234 are provided on the internal surface of the collar 232 (one not shown). The protrusions 234 are adapted to engage a slot 90 (see FIG. 1*b*) or three separate slots provided near the distal end 22 of the handle 20. The slot 90 extends at least partially around an outer surface of the inner wall 60 and is helical so both a rotational and longitudinal movement is required to attach or remove the head from the handle 20. This is one example of a fixing mechanism, it will be apparent to the skilled person that other equally acceptable alternative mechanisms could be used.

The heads 30, 130, 180 and 230 described with respect to FIGS. 3*a* to 9*b* could be provided with bristles. For these heads 30, 130, 180 and 230 as the slots are arranged all the way around the head, any bristles would be arranged all the way around the head. An example would be to have one or more rows of bristles at least located on every other plate 110, 210.

The invention has been described in detail with respect to a hot styling brush however, it is applicable to any appliance that draws in a fluid and directs the outflow of that fluid from the appliance including a hairdryer.

The appliance can be used with or without a heater; the action of the outflow of fluid at high velocity has a drying effect.

The heads have been described as being manufactured by attaching a first part to the second part using a screw however, as the skilled person will be aware, a number of different fixing methods can be used such as, but not limited to gluing or using ultrasonic welding.

The fluid that flows through the appliance is generally air, but may be a different combination of gases or gas and can include additives to improve performance of the appliance or the impact the appliance has on an object the output is directed at for example, hair and the styling of that hair. Such additives include but are not limited to hairspray and serums for example.

The heads 30, 130, 230 are all generally cylindrical in shape, however as the skilled person would realise, alternative shapes could be used such as ovals.

The invention is not limited to the detailed description given above. Variations will be apparent to the person skilled in the art.

The invention claimed is:

1. A hair curling attachment configured for attaching to a hand held appliance, the attachment comprising a body formed by a plurality of imperforate overlapping plates that extend in a longitudinal direction of the attachment and around a longitudinal axis of the attachment forming a cylindrical outer wall of the attachment, a collar located at a first end of the body for attaching the attachment to the hand held appliance, a fluid inlet at the first end of the body and a fluid outlet that comprises at least one slot through which fluid exits the attachment, the at least one slot extending in the longitudinal direction and formed by a radially inner facing surface of a first plate of the plurality of plates directly overlapping a radially outer facing surface of a second plate of the plurality of plates over an entire longitudinal length of the at least one slot such that fluid is directed between the radially inner facing surface and the radially outer facing surface, wherein each plate of the plurality of plates extends in the longitudinal direction from the collar to a closed distal end of the attachment, and wherein the attachment is configured to direct the fluid emitted from the at least one slot tangentially along and around the cylindrical outer wall thereby encouraging wrapping hair around the cylindrical outer wall of the attachment for curling the hair.

2. A hand held appliance comprising a handle having a fluid flow path from a first fluid inlet to a first fluid outlet and a fan unit for drawing fluid into the first fluid inlet and a hair curling attachment attached to the handle, the attachment comprising a body formed by a plurality of imperforate overlapping plates that extend in a longitudinal direction of the attachment and around a longitudinal axis of the attachment forming a cylindrical outer wall of the attachment, a collar located at a first end of the body for attaching the attachment to the handle, a second fluid inlet at the first end of the wall which, when the attachment is attached to the handle is in fluid communication with the first fluid outlet of the handle, and a second fluid outlet that comprises at least one slot through which fluid exits the attachment, the at least one slot extending in the longitudinal direction and formed by a radially inner facing surface of a first plate of the plurality of plates directly overlapping a radially outer facing surface of a second plate of the plurality of plates over an entire longitudinal length of the at least one slot such that fluid is directed between the radially inner facing surface and the radially outer facing surface, wherein each plate of the plurality of plates extends in the longitudinal direction from the collar to a closed distal end of the attachment, and wherein the attachment is configured to direct the fluid emitted from the at least one slot tangentially along and around the cylindrical outer wall thereby encouraging wrapping hair around the cylindrical outer wall of the attachment for curling the hair.

3. The attachment of claim 1, wherein the second plate defines an inner side of the at least one slot.

4. The attachment of claim 1, wherein the first plate defines an outer side of the at least one slot.

5. The attachment of claim 1, wherein the attachment is generally tubular.

6. The attachment of claim 5, wherein the plurality of plates form at least a portion of the generally tubular shape of the attachment.

7. The attachment of claim 1, wherein fluid exiting the fluid outlet flows along an inner side of the at least one slot.

8. The attachment of claim 1, wherein the fluid outlet comprises n slots and the body comprises n plates.

9. The attachment of claim 1, wherein the body includes at least one spacer located between ends of the at least one slot for maintaining a thickness of the at least one slot.

10. The attachment of claim 9, wherein at least one spacer extends from an edge of the first plate to an edge of the second plate.

11. The attachment of claim 9, wherein a pair of spacers are provided longitudinally spaced along the body.

12. The attachment of claim 1, wherein the at least one slot is formed as a spiral around the body.

13. The attachment of claim 12, wherein the spiral is clockwise in a direction of fluid flow.

14. The attachment of claim 12, wherein the spiral is anticlockwise in a direction of fluid flow.

15. The attachment of claim 1, wherein the at least one slot is disposed at an angle of 1-89° to the longitudinal direction of the attachment.

16. The attachment of claim 1, wherein the at least one slot is disposed at an angle of 10-70° to the longitudinal direction of the attachment.

17. The attachment of claim 1, wherein the at least one slot is disposed at an angle of 30-60° to the longitudinal direction of the attachment.

18. The attachment of claim 1, wherein the at least one slot is disposed at an angle of 45° to the longitudinal direction of the attachment.

19. The attachment of claim 1, wherein the plurality of plates are lined with a material.

20. The attachment of claim 1, further comprising a flow directing element between the fluid inlet and the fluid outlet.

21. The attachment of claim 20, wherein the flow directing element comprises a perforated layer.

22. The appliance of claim 2, wherein the body of the attachment is substantially the same diameter as the handle.

23. The appliance of claim 2, wherein the body of the attachment is a different diameter to that of the handle.

24. The appliance of claim 23, wherein the attachment has a smaller diameter to the handle.

25. The appliance of claim 23, wherein the attachment has a greater diameter then the handle.

26. The appliance of claim 2, wherein second plate defines an inner side of the at least one slot.

27. The appliance of claim 2, wherein the first plate defines an outer side of the at least one slot.

28. The appliance of claim 2, wherein the attachment is generally tubular.

29. The appliance of claim 28, wherein the plurality of plates form at least a portion of the generally tubular shape of the attachment.

30. The appliance of claim 2, wherein the at least one slot is tangential to the body.

31. The appliance of claim 30, wherein fluid exiting the second fluid outlet flows along an inner side of the at least one slot.

32. The appliance of claim 2, wherein the second fluid outlet comprises n slots and the body comprises n plates.

33. The appliance of claim 2, wherein the attachment includes at least one spacer which defines a thickness of the at least one slot.

34. The appliance of claim 33, wherein the at least one spacer extends from an edge of the first plate to an edge of the second plate.

35. The appliance of claim 33, wherein a pair of spacers are provided longitudinally spaced along the body.

36. The appliance of claim 2, wherein the at least one slot is formed as a spiral around the body.

37. The appliance of claim 36, wherein the spiral is clockwise in a direction of fluid flow.

38. The appliance of claim 36, wherein the spiral is anticlockwise in a direction of fluid flow.

39. The appliance of claim 2, wherein the at least one slot is disposed at an angle of 1-89° to the longitudinal direction of the attachment.

40. The appliance of claim 2, wherein the at least one slot is disposed at an angle of 10-70° to the longitudinal direction of the attachment.

41. The appliance of claim 2, wherein the at least one slot is disposed at an angle of 30-60° to the longitudinal direction of the attachment.

42. The appliance of claim 2, wherein the at least one slot is disposed at an angle of 45° to the longitudinal direction of the attachment.

43. The appliance of claim 2, wherein the plurality of plates are lined with a material.

44. The appliance of claim 2, further comprising a flow directing element between the second fluid inlet and the second fluid outlet.

* * * * *